US005812923A

United States Patent [19]

Yamauchi et al.

[11] Patent Number: 5,812,923

[45] Date of Patent: Sep. 22, 1998

[54] IMAGE FORMING APPARATUS EQUIPPED WITH REGISTER ROLLERS FOR CURLING TRANSFER PAPER

[75] Inventors: Kouichi Yamauchi; Hiroshi Tachiki, both of Yamatokoriyama; Hiromu Yoshimoto, Yamabe-gun; Atsuyuki Katoh, Tenri; Yuhi Akagawa, Ikoma; Takayuki Ohno, Yamatokoriyama; Yoshinobu Tateishi, Shiki-gun; Keizo Fukunaga, Ikoma; Mitsuyoshi Terada, Nara; Fumio Shimazu, Chiba; Takuya Abe, Chiba; Kiyoshi Toizumi, Chiba, all of Japan

[73] Assignee: Sharp Kabushiki Kaisha, Osaka, Japan

[21] Appl. No.: 764,618

[22] Filed: Dec. 11, 1996

Related U.S. Application Data

[62] Division of Ser. No. 383,732, Feb. 3, 1995, Pat. No. 5,623,329.

[30] Foreign Application Priority Data

| | | | |
|---|---|---|---|
| Feb. 4, 1994 | [JP] | Japan | 6-12964 |
| Feb. 4, 1994 | [JP] | Japan | 6-12965 |
| Feb. 4, 1994 | [JP] | Japan | 6-12968 |
| Nov. 29, 1994 | [JP] | Japan | 6-295194 |

[51] Int. Cl.[6] ..... G03G 15/00

[52] U.S. Cl. ..... 399/388; 399/389; 399/390; 399/406

[58] Field of Search ..... 399/45, 388, 389, 399/390, 406; 162/270, 271; 271/188, 209

[56] References Cited

U.S. PATENT DOCUMENTS

| | | | |
|---|---|---|---|
| 4,475,896 | 10/1984 | Bains | 493/454 |
| 5,113,226 | 5/1992 | Tadokoro et al. | 399/390 |
| 5,442,429 | 8/1995 | Bartholmae et al. | 399/406 |
| 5,565,970 | 10/1996 | Suda | 399/406 |
| 5,572,308 | 11/1996 | Suda et al. | 399/406 X |
| 5,602,636 | 2/1997 | Matsuzawa | 399/388 |

FOREIGN PATENT DOCUMENTS

| | | |
|---|---|---|
| 42-025 235 | 12/1967 | Japan . |
| 55-052 446 | 12/1980 | Japan . |
| 2-74975 | 3/1990 | Japan . |
| 4-256977 | 9/1992 | Japan . |

*Primary Examiner*—William J. Royer
*Attorney, Agent, or Firm*—David G. Conlin; David D. Lowry

[57] ABSTRACT

An image forming apparatus of the present invention includes a photoreceptor drum on which a toner image is formed, a transfer drum for transferring the toner image formed to transfer paper by bringing the transfer paper into contact with the photoreceptor drum, and a pair of register rollers for supplying the transfer paper to the transfer drum at a predetermined time and for curling the transfer paper in an arc. The register rollers include first and second rollers pressed against each other, the first roller being a predetermined hardness and the second roller being a hardness larger than the first roller. The transfer drum is disposed on the same side as the second roller with respect to an imaginary tangent line touching the surface of the second roller at one end of a contact section between the first and second rollers. The image forming apparatus also includes transporting means for supplying the transfer paper to the register rollers so that a front edge of the transfer paper comes into contact with the second roller, temporarily stops, and then continues to the transfer drum. The image forming apparatus also includes a means for changing the pressure that the register rollers are pressed together. Paper type, quality, thickness, and size are detected and the pressure is adjusted accordingly. The means for changing pressure includes a resilient member for the pressing the second roller against the first, and a changing member for changing the amount of deformation of the resilient member.

17 Claims, 23 Drawing Sheets

IMAGE FORMING APPARATUS EQUIPPED WITH REGISTER ROLLERS FOR CURLING TRANSFER PAPER

This is a divisional of application Ser. No. 08/383,732 filed on Feb. 3, 1995, now U.S. Pat. No. 5,623,329.

FIELD OF THE INVENTION

The present invention relates to image forming apparatuses such as a copying machine, laser printer, digital printer, scanner printer, facsimile machine, and laser facsimile machine, and more particularly to a structure for satisfactorily transferring a toner image formed on a photoreceptor to a sheet of recording material such as recording paper by holding the recording material on a surface of a transfer body, for example, a transfer drum and a structure for satisfactorily separating the recording material from the transfer body.

BACKGROUND OF THE INVENTION

In recent years, regarding an image forming apparatus for forming an image on recording paper, the following structure has been proposed. With this structure, the recording paper adheres to and is held on a transfer drum which is in contact with and rotates together with a photoreceptor drum. An electrostatic latent image formed on the photoreceptor drum is developed into a toner image by attracting toner to the electrostatic image, and the toner image is then transferred to transfer paper wound around the transfer drum.

For example, as illustrated in FIG. 31, an image forming apparatus of this type includes a cylinder 101 provided with a dielectric layer 101*a* as the transfer drum. Disposed separately inside the cylinder 101 are a corona charger 102 for attracting transfer paper P, and a corona charger 104 for transferring a toner image formed on a surface of a photoreceptor drum 103 to the transfer paper P. The adhesion and transfer of the transfer paper P are separately carried out by the charger 102 and 104.

An image forming apparatus shown in FIG. 32 includes a cylinder 201 having a double-layer structure formed by a semi-conductive layer 201*a* as an outer layer and a substrate 201*b* as an inner layer, and a grip mechanism 202 for holding the transported transfer paper P around the cylinder 201. Then, the toner image on the photoreceptor drum 103 is transferred to the transfer paper P by applying a voltage to the semi-conductive layer 201*a* as the outer layer of the cylinder 201 or charging a surface of the cylinder 201 by discharges of a charger in the cylinder 201.

However, in the image forming apparatus shown in FIG. 31, since the cylinder 101 as the transfer roller has a single-layer structure formed by only the dielectric layer 101*a*, it is necessary to dispose the corona chargers 102 and 104 therein. This structure restricts the size of the cylinder 101, and prevents a reduction in the size of the image forming apparatus.

Whereas in the image forming apparatus shown in FIG. 32, since the cylinder 201 as the transfer roller has a double-layer structure, it is possible to reduce the number of chargers for charging the cylinder 201 so as to transfer the toner image to the transfer paper P. However, since the grip mechanism 202 is included in the image forming apparatus, the overall structure of the apparatus becomes complicated. As a result, the total number of component parts in the apparatus and the manufacturing cost of the apparatus are increased.

In order to solve the above problems, for example, Japanese Publication for Unexamined Patent Application No. 74975/1990 discloses a structure in which a transfer drum is formed by laminating a grounded metal roller with a conductive rubber and a dielectric film, and a corona charger is disposed in the vicinity of a position where transfer paper is separated from the transfer drum. In this structure, the corona charger is driven by a unipolar power source.

In this image forming apparatus, the transfer paper is attracted to the transfer drum by inducing charges on a dielectric film by means of the corona charger. When the transfer paper adheres to the transfer drum, more charges are induced, thereby allowing a transfer of an image.

In the image forming apparatus, a surface of the transfer drum is charged by a single charger so as to attract transfer paper and transfer the image to the transfer paper. Since only one charger is necessary, a reduction in the size of the transfer drum is achieved. Moreover, since a mechanism such as a grip mechanism is not required to hold the transfer paper, it is possible to attract the transfer paper with a simplified structure.

However, in the image forming apparatus disclosed in the above-mentioned publication, the surface of the transfer drum is charged by atmospheric discharges of the corona charger. Therefore, when forming a color image, i.e., when executing a transfer process a plurality of times, charges are supplied by the corona charger every time a transfer is completed. It is thus necessary to include a charger unit formed by, for example, a unipolar power source. This causes increases in the number of component parts of the apparatus and the manufacturing cost of the apparatus.

When the surface of the transfer drum is scratched and when charging is carried out by atmospheric discharges, an electric field becomes smaller and loses its balance at the scratched area. Consequently, a transfer defect occurs, for example, a blank portion is produced at the scratched area, lowering the image quality.

Additionally, since the surface of the transfer roller is charged by the atmospheric discharges, an increased voltage is required for charging, and the driving energy of the image forming apparatus becomes larger. Furthermore, since the atmospheric discharges are easily affected by environmental conditions such as the temperature and moisture in the air, the surface potential of the transfer roller tends to be varied. As a result, failure in attracting the transfer paper and disorderly images are likely to occur.

Recently, a copying machine capable of printing a copy of an image on a sheet which is commonly used for clerical work, a plastic sheet, a post card, an envelope or a label (hereinafter just referred to as the transfer paper) as well as on a special copy sheet (so-called copy paper or ordinary paper) is known. As illustrated in FIG. 33, a transfer device (see Japanese Publication for Examined Patent Application No. 25235/1967, for example) for use in such a copying machine includes a transfer drum 90 for transferring a toner image formed on a surface of a photoreceptor drum (not shown) to transfer paper 99. Disposed in an upstream section of the transfer drum 90 in a transfer-paper transport path 95 are transport rollers 91 and register rollers 92. A pair of curl rollers formed by a hard roller 93 and a soft roller 94 are provided between the transfer drum 90 and register rollers 92. The hard roller 93 curls up the transfer paper 99 in an arc along the transfer drum 90 so that the transfer paper 99 is easily wound around the transfer drum 90.

The soft roller 94 is pressed against the hard roller 93 so that the hard roller 93 cuts into the soft roller 94 at the contact position. Therefore, when the transfer paper 99 passes through the contact position between the hard roller 93 and the soft roller 94, the transfer paper 99 curls up toward the hard roller 93. The transfer paper 99 is thus easily wound around the transfer drum 90. Here, the transfer paper 99 is wound and held on the transfer drum 90, for example, by electrostatic adhesion.

However, in the conventional copying machine, the hard roller 93 and the soft roller 94 are positioned in a downstream section of the soft roller 94 and the register rollers 92 on the transfer-paper transport path 95. Therefore, even if the transfer paper 99 is supplied by the register rollers 92 to the transfer drum 90 at a predetermined time in relation with the image formation, the timing may vary at the time the transfer paper 99 passes through the contact position between the hard roller 93 and the soft roller 94. If the transfer paper 99 is not supplied to the transfer drum 90 at the predetermined time, the toner image is transferred to a displaced position on the transfer paper 99, resulting in an undesired transfer. Moreover, when the hard roller 93 and the soft roller 94 are provided, the transfer-paper transport path 95 becomes longer. Consequently, it becomes harder to supply the transfer paper 99 to the transfer drum 90 at the predetermined time, and the possibility of a so-called paper jam is increased.

In addition, since the hard roller 93 and the soft roller 94 are fixed in predetermined positions, the amount of cut of the hard roller 93 to the soft roller 94 is always uniform. Specifically, the degree of curl of the transfer paper 99 can not be changed depending on the type, paper quality and thickness of the transfer paper 99. Namely, since there are variations in the degree of curl of the transfer paper 99 depending on the type, paper quality and thickness of the transfer paper 99, it is difficult to stably supply the transfer paper 99 having a uniform degree of curl to the transfer drum 90.

For instance, when the transfer paper 99 is thin and soft, the degree of curl of the transfer paper 99 becomes too large and the transfer paper 99 is tightly wound around the transfer dram 90. It is therefore hard to separate the transfer paper 99 from the transfer drum 90, and paper jam is apt to occur. On the other hand, if the transfer paper 99 is thick and hard, the degree of curl of the transfer paper 99 becomes too small. As a result, the transfer paper 99 is hard to be wound around the transfer drum 90, and the toner image tends to be transferred in a displaced position on the transfer paper 99.

Moreover, if an envelope is used as the transfer paper 99, the envelope is likely to be crinkled because the degree of curl can not be adjusted. If a label formed by an adhesive label paper and back paper is used as the transfer paper 99, when the label paper is curled up, it tends to separate from the back paper. When the degree of curl is set to a value optimum for the envelope or the label, if transfer paper other than the envelope and the label is used as the transfer paper 99, the degree of curl becomes too small. Therefore, the transfer paper 99 is hard to be wound around the transfer drum 90, and the toner image is transferred to a displaced position on the transfer paper 99.

Thus, there is a demand for an image forming apparatus capable of curling transfer paper without changing the timing for supplying the transfer paper to the transfer drum. There is also a demand for an image forming apparatus capable of freely adjusting the degree of curl of transfer paper depending on the type, paper quality and thickness of the transfer paper.

In order to separate the transfer paper to which the toner image has been transferred from the transfer drum, a separating claw with a pointed edge is provided so that it comes into contact with and out of contact with an outer surface of the transfer drum. The separating claw is conventionally arranged in various positions on a transport path of the transfer paper. For example, Japanese Publication for Examined Patent Application 52446/1980 discloses an electrophotographic copying machine including a heat roller 81 and a pressure roller 82 which are in contact with each other and rotate together, and a separating claw 83 having a pointed edge which comes into contact with a surface of the heat roller 81 as shown in FIG. 34. In this case, the toner image on recording paper 84 is fixed when the recording paper 84 passes between the rollers 81 and 82. The separating claw 83 prevents the recording paper 84 from being wound around the heat roller 81.

The following description discusses an example where such a claw is provided for separating transfer paper adhering to the transfer drum. As illustrated in FIG. 35, a transfer drum 86 which attracts and holds transfer paper P thereon is disposed in contact with the photoreceptor drum 85. A separating claw 87 is provided so that it comes into contact and out of contact with an outer surface of the transfer drum 86. A substantially V-shaped space S is formed between the outer surfaces of the photoreceptor drum 85 and transfer drum 86 in a transfer region where the drums 85 and 86 are in contact with each other, located near a fixing unit 88. The installation position of the separating claw 87 is determined so that the edge of the separating claw 87 enters into the space S as far as possible to come into contact with the outer surface of the transfer drum 86 at a position closer to the contact position between the photoreceptor drum 85 and transfer drum 86.

However, in the conventional apparatus, since the transfer paper P is separated from the transfer drum 86 near the contact position between the photoreceptor drum 85 and transfer drum 86 and sent to the fixing unit 88, distortion of an image may occur or paper jam may be caused by unsatisfactory transport of the transfer paper.

Namely, with the above-mentioned configuration, as illustrated in FIG. 36, after the transfer paper P is separated by the separating claw 87, it is guided to an upward direction along the separating claw 87. Moreover, the transfer paper P which has been attracted to and held on the outer surface of the transfer drum 86 is curled according to a curvature of the outer surface of the transfer drum 86. Therefore, when the attracting and holding forces for the transfer paper P are cancelled after the transfer paper has passed through a separating point where the separating claw 87 comes into contact with the outer surface of the transfer drum 86, it is not certain whether the transfer paper P is moved along the surface of the separating claw 87. In addition, after the transfer paper P passes through the separating point, it is moved in the upward direction while being undulated and deviated. As a result, as illustrated by the broken line in FIG. 36, there is a possibility that the transfer paper is bent nearly at 90° at the separating point. At this time, the bent transfer paper comes into contact with the photoreceptor drum 85 and a cleaning unit 89 which are located on a side toward which the transfer paper is bent. This may cause distortion of an image and paper jam.

Furthermore, in the conventional apparatus, after the front edge of the transfer paper P starts to be separated from the transfer drum, the separating claw 87 is kept in contact with the transfer drum 86 at least until the rear edge of the transfer paper P passes through the separating point. Thereafter, the claw 87 is controlled to be separated from the surface of the transfer drum 86. Since the contact time in which the separating claw 87 is in contact with the transfer drum 86 is long, the surface of the transfer drum 86 tends to be damaged, for example, scratched.

SUMMARY OF THE INVENTION

In order to solve the above problems, the most important object of the present invention is to provide an image forming apparatus having a transfer device capable of satisfactorily performing a series of transfer processes including the adhesion of transfer paper to a transfer drum, the transfer of a toner image from the transfer drum to the transfer paper, and the separation of the transfer paper from the transfer drum, and of significantly decreasing disorderly images on the transfer paper and paper jam.

It is another object of the present invention to provide an image forming apparatus incorporating a transfer device which has a simplified structure but is capable of preventing unsatisfactory adhesion of transfer paper to the transfer device and unsatisfactory transfers of a toner image to the transfer paper and of forming a satisfactory image on the transfer paper by stably holding a uniform surface potential of the transfer drum.

It is still another object of the present invention to provide an image forming apparatus capable of increasing the durability of the transfer drum.

In order to achieve the above objects, an image forming apparatus of the present invention includes at least:

(1) an image carrying body (for example, a photoreceptor drum) on which a toner image is formed;

(2) transfer means (for example, a transfer drum) for transferring the toner image formed on the image carrying body to transfer paper by bringing the transfer paper into contact with the image carrying body, the transfer means having a dielectric layer, a semi-conductive layer and a conductive layer laminated in this order from a contact surface side of the transfer paper;

(3) voltage applying means (for example, a direct current power source), connected to the conductive layer, for applying a predetermined voltage to the conductive layer; and (4) potential-difference producing means (for example, a grounded conductive roller, a conductive roller to which a voltage whose polarity is opposite to that of the voltage applying means has been applied, or a photoreceptor drum) for pressing supplied transfer paper against a surface of the dielectric layer, and for producing a potential difference between the conductive layer to which the voltage has been applied and the transfer paper.

With this structure, the potential-difference producing means presses the supplied transfer paper against the surface of the dielectric layer of the transfer means, and produces a potential difference between the conductive layer of the transfer means and the transfer paper. As a result, charges of the same polarity as that of the voltage applied to the conductive layer accumulate on the semi-conductive layer, and charges of the same polarity are also induced on the dielectric layer and the surface of the transfer paper pressed against the surface of the dielectric layer. Namely, charges of a polarity opposite to that of the voltage applied to the conductive layer are induced on the back surface of the transfer paper which is in contact with the dielectric layer.

It is therefore possible to cause the transfer paper to adhere to the surface of the dielectric layer, i.e., the surface of the transfer means by electrostatic adhesion by connecting the voltage applying means to the conductive layer and simply applying the voltage thereto. Moreover, the toner image is transferred to the transfer paper by producing a predetermined difference between a potential by the charge on the transfer paper surface and a potential by the charge of the toner image on the image carrying body.

Thus, with the present invention, the adhesion of the transfer paper to the transfer means and the transfer of the toner image are performed by inducing charges rather than injecting charges by atmospheric discharge of a conventional method. With this arrangement, a lower voltage is used, and the voltage is easily controlled. In addition, since the voltage to be applied to the transfer means is kept uniform without having environmental influences such as humidity and temperatures, the transfer efficiency and the image quality are improved.

Additionally, the transfer paper more stably adheres to the transfer means by applying a voltage whose polarity is opposite to that of the voltage applying means to the potential-difference producing means. Specifically, charges of opposite polarity to that of the voltage applied to the conductive layer flow to the transfer paper from the potential-difference producing means, while charges of the same polarity as that of the voltage applied to the conductive layer flow to the semi-conductive layer from the voltage applying means. As a result, the opposite charges further accumulate on the surface of the conductive layer and the back surface of the transfer paper which is in contact with the dielectric layer, respectively. Hence, the adhesion of the transfer paper to the transfer means is enhanced.

Furthermore, even if the voltage to be applied to the conductive layer by the voltage applying means is decreased, it is possible to ensure a sufficient potential difference between the conductive layer and the transfer paper for achieving stable adhesion of the transfer paper to the transfer means. This prevents an undesirable back transfer due to an excessively high charging voltage of the transfer means.

In general, the image forming apparatus includes a pair of register rollers for timely supplying the transfer paper to the transfer means. It is possible to use the register rollers as pre-curl rollers for curling the transfer paper in an arc, which is to be supplied to the transfer means. In this case, if the transfer means has a cylindrical surface and causes the transfer paper to adhere to the cylindrical surface, the curled transfer paper more easily adheres to the transfer means. Namely, it is possible to improve the adhesion of the transfer paper to the transfer means without adding a new structure.

When using the register rollers which are pressed against each other as pre-curl rollers as described above, the hardness of a second roller of the register rollers which is located closer to the transfer means is set larger than a first roller. In addition, imagining a tangent plane touching the second roller surface at one end of the contact section of the first and second rollers which is closer to the transfer means, it is desirable to dispose the transfer means and the second roller on the same side of the tangent plane.

This arrangement facilitates the winding of the transfer paper around the transfer means without catching the transfer paper on the transfer means. Moreover, the transport path of the transfer paper is shortened compared to a conventional transport path by using the register rollers as the pre-curl rollers, thereby decreasing the possibility of causing paper jam. Furthermore, this arrangement prevents such a problem that the transfer paper is supplied to the transfer means at a wrong time which occurs in the structure in which the register rollers and the pre-curl rollers are separately provided. It is therefore possible to stably transfer the toner image to a desired location on the transfer paper.

Additionally, if the pressure for pressing the first and second rollers against each other is made freely changeable, the degree of curl given to the transfer paper becomes uniform without regard to the type, paper quality and thickness of the transfer paper. Consequently, the transfer paper is satisfactorily supplied to the transfer means.

When the separating claw for removing the transfer paper from the transfer means is disposed between the fixing unit and the contact section of the image carrying body and the transfer means, it is preferable to arrange the contact point of the edge of the separating claw and the surface of the transfer means to be separated from the contact section by a predetermined distance. More specifically, denoting the cylindrical surface of the image carrying body at the contact section as a first contact surface and the cylindrical surface of the transfer means at the contact section as a second contact surface and assuming that a radius of the second contact surface is larger than that of the first contact surface, it is desirable to bring the separating claw to come into contact with the second contact surface at a position which is separated by a distance longer than a radius of the first contact surface from a straight line which connects the center of the circumference of the first contact surface and that of the second contact surface by the shortest distance when removing the transfer paper.

With this configuration, when the transfer paper is separated from the transfer means, even if the moving direction of the transfer paper which runs along the surface of the transfer means is largely shifted toward the image carrying body due to the lifting of the transfer paper by the separating claw which in contact with the surface of the transfer means, the possibility of causing the separated transfer paper to come into contact with the surface of the image carrying body is reduced. Therefore, even when the separated transfer paper is fed to the fixing unit while being curved or undulated, it can never come into contact with the image carrying body, preventing disorderly images and paper jam.

Furthermore, after starting the separation of the transfer paper, if the separating claw is separated from the transfer means before the rear edge of the transfer paper passes the separating claw, the contact time of the separating claw and the transfer means is shortened. Since this arrangement prevents such a problem that the surface of the transfer means gets scratched, the durability of the transfer body is increased.

For a fuller understanding of the nature and advantages of the invention, reference should be made to the ensuing detailed description taken in conjunction with the accompanying drawings.

DESCRIPTION OF THE PREFERRED EMBODIMENTS

[Embodiment 1]

The following description discusses one embodiment of the present invention with reference to FIGS. 1 to 9.

Figure 2:
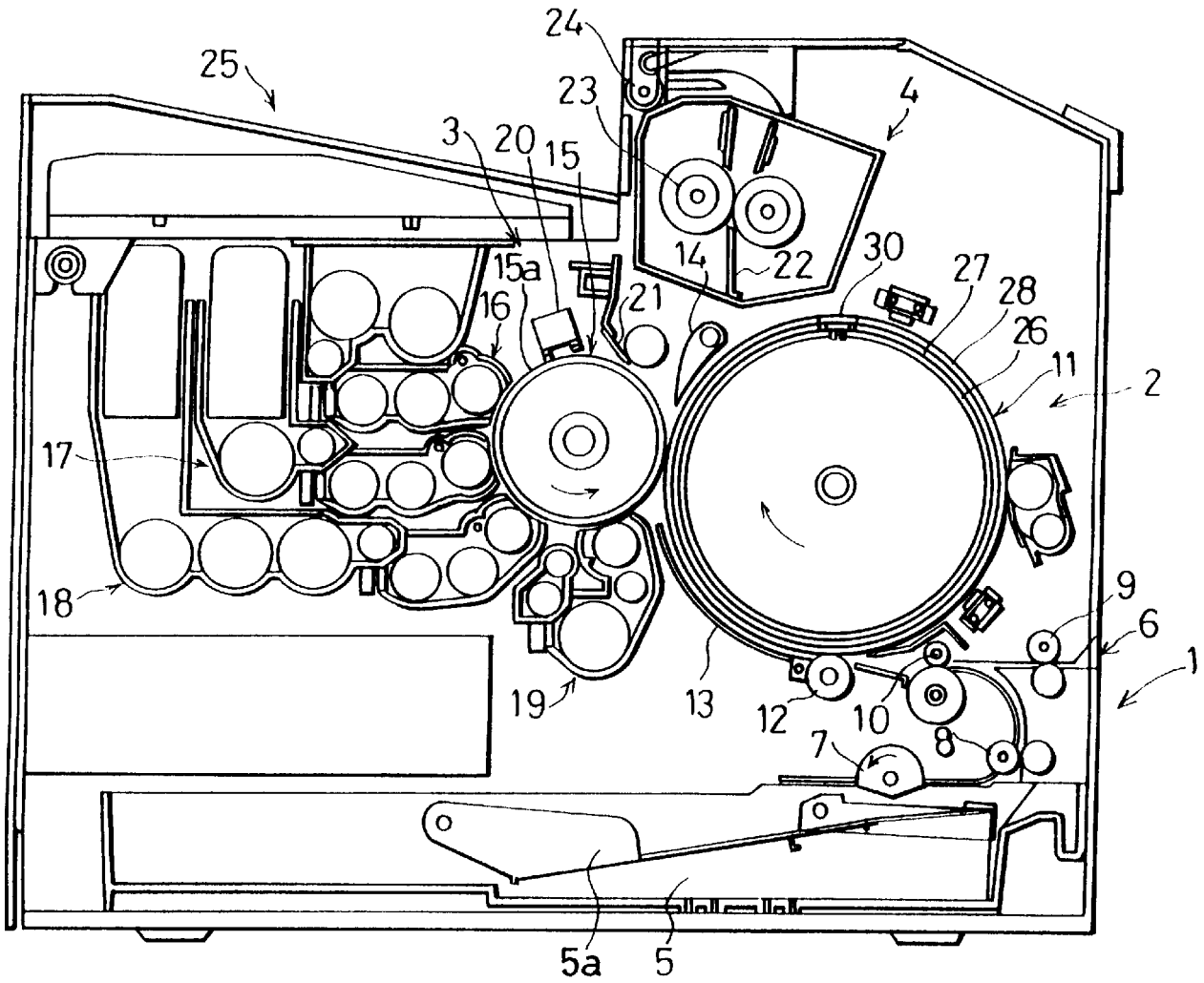
FIG. 2 schematically shows the structure of the image forming apparatus including the transfer drum of FIG. 1.

As illustrated in FIG. 2, an image forming apparatus of the present invention includes a feeding section 1, a transfer section 2, a development section 3, and a fixing section 4. The feeding section 1 stores and feeds transfer paper as recording paper on which an image is to be formed by toner. The transfer section 2 transfers a toner image to the transfer paper. The development section 3 forms the toner image. The fixing section 4 fuses and fixes the toner image transferred to the transfer paper.

The feeding section 1 includes a feed cassette 5, a manual-feed section 6, a pickup roller 7, PF (pre-feed) rollers 8, manual-feed rollers 9, and pre-curl rollers 10. The feed cassette 5 is disposed on the lowest level of a main body so that it is freely attachable to and detachable from the main body. The feed cassette 5 stores transfer paper and supplies it to the transfer section 2. The manual-feed section 6 is located on the front side of the main body and through which the transfer paper is manually supplied sheet by sheet from the front side. The pickup roller 7 feeds one sheet at a time from the topmost sheet of the transfer paper in the feed cassette 5. The PF rollers 8 transport the transfer paper fed by the pickup roller 7. The manual-feed rollers 9 transport the transfer paper fed from the manual-feed section 6. The pre-curl rollers 10 curl the transfer paper transported by the PF rollers 8 and the manual-feed rollers 9. The pre-curl rollers 10 are also called PF rollers 10.

The feed cassette 5 has a feeding member 5*a* pushed upward by, for example, a spring. The transfer paper is placed on the feeding member 5*a* in the feed cassette 5, and the topmost sheet of the transfer paper comes into contact with the pickup roller 7. When the pickup roller 7 is rotated in the direction of an arrow, the transfer paper is fed sheet by sheet to the PF rollers 8. The transfer paper is then transported to the pre-curl rollers 10.

Meanwhile, the transfer paper supplied from the manual-feed section 6 is transported to the pre-curl rollers 10 by the manual-feed rollers 9.

As described above, the pre-curl rollers 10 curl the transported transfer paper so that it easily adheres to a surface of a cylindrical transfer drum 11 in the transfer section 2.

The transfer section 2 includes the transfer drum 11 as transferring means. Disposed around the transfer drum 11 are a conductive roller 12, a guide member 13, and a separating claw 14. The conductive roller 12 functions as potential-difference producing means and rotates as the transfer drum 11 is rotated. The guide member 13 guides the transfer paper so that it is not separated from the transfer drum 11. The separating claw 14 forcefully separates the transfer paper adhering to the transfer drum 11. The structure of the transfer drum 11 will be explained in detail later. The separating claw 14 is movable to touch or separate from the surface of the transfer drum 11.

The development section 3 includes a photoreceptor drum 15 as an image carrier which is brought into contact with the transfer drum 11 by pressure. The photoreceptor drum 15 is formed by a grounded conductive aluminum tube 15*a*, and an OPC film 15*b* (see FIGS. 8 and 9) formed on a surface thereof. The diameter of the photoreceptor drum 15 is smaller than that of the transfer drum 11.

Arranged radially around the photoreceptor drum 15 are developer containers 16, 17, 18 and 19, a charger 20, and a cleaning blade 21. The developer containers 16, 17, 18, 19 contain yellow, magenta, cyan and black toner, respectively. The charger 20 charges the surface of the photoreceptor drum 15. The cleaning blade 21 scrapes and removes the toner remaining on the surface of the photoreceptor drum 15. Toner images in the respective colors are formed on the photoreceptor drum 15. More specifically, with the photoreceptor drum 15, a series of charging, exposing, developing and transfer processes are carried out for each of the toner colors. Therefore, when transferring a color image, a toner image in one color is transferred to the transfer paper which is electrostatically attracted to the transfer drum 11 by one rotation of the transfer drum 11. Namely, a color image is obtained by a maximum of four rotations of the transfer drum 11.

Considering the transfer efficiency and the image quality, the photoreceptor drum 15 and the transfer drum 11 are brought into contact with each other by pressure so that a pressure of about 8 Kg is applied at a transfer position.

The fixing section 4 includes fixing rollers 23, and a fixing guide 22. The fixing rollers 23 fix the toner image to the transfer paper by fusing the toner image at a predetermined temperature and pressure. The transfer paper, which has been separated from the transfer drum by the separating claw 14 after the transfer of the toner image, is guided to the fixing rollers 23 by the fixing guide 22. A discharge roller 24 is disposed at a downstream section of the transfer-paper transport path in the fixing section 4 so that the transfer paper carrying the toner image fixed thereon is discharged from the main body of the apparatus onto an output tray 25.

The following description discusses the structure of the transfer drum 11.

Figure 1:
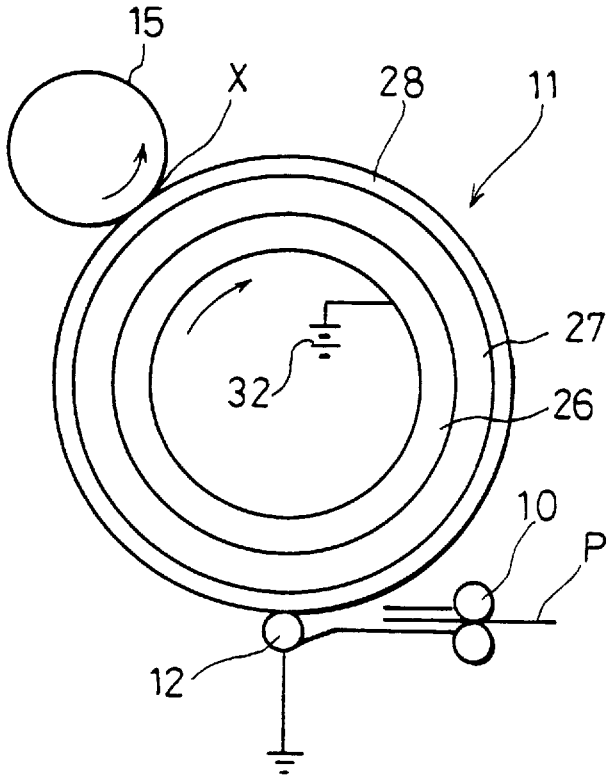
FIG. 1 schematically shows the structure near a transfer drum in an image forming apparatus according to one embodiment of the present invention.

As illustrated in FIG. 1, the transfer drum 11 includes a cylindrical conductive layer 26 as a base member, a semi-conductive layer 27 on an upper surface of the conductive layer 26, and a dielectric layer 28 on an upper surface of the semi-conductive layer 27. The conductive layer 26, semi-conductive layer 27 and dielectric layer 28 are formed by aluminum, resilient urethane foam, and polyvinylidene fluoride, respectively.

The conductive layer 26 is connected to a power source section 32 as voltage applying means so that a constant voltage is held throughout the conductive layer 26.

Figure 3:
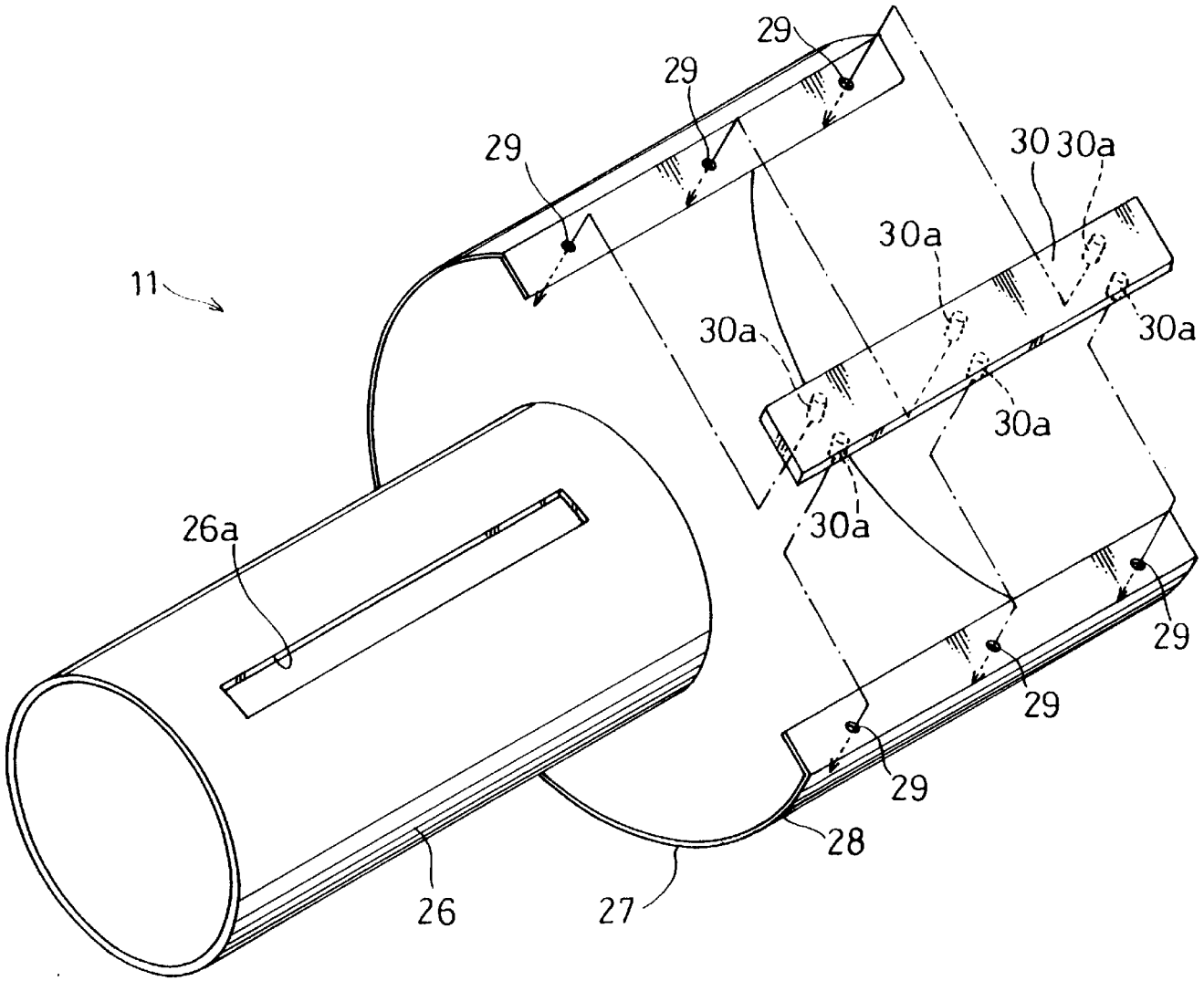
FIG. 3 is an explanatory view showing a coupling state of a conductive layer, a sheet of semi-conductive layer and a sheet of dielectric layer forming the transfer drum of FIG. 1.

The layers 26, 27, 28 are not joined together by bonding agents. For example, as illustrated in FIG. 3, the layers 27 and 28 are fixed to the conductive layer 26 using a holding plate 30 (fixing means) having bosses 30*a*. The semi-conductive layer 27 and the dielectric layer 28 are shaped into sheet form, and wound one upon another around the conductive layer 26. An opening 26*a* in the form of a slit is formed on the upper surface of the conductive layer 26. Both ends of each of the semi-conductive layer 27 and the dielectric layer 28 wound on the conductive layer 26 reach the opening 26*a*. A plurality of through-holes 29 are formed on the respective ends of the layers 27 and 28. Thus, when the holding plate 30 is inserted into the opening 26*a* so that the bosses 30*a* fit into the through-holes 29, the semi-conductive layer 27 and the dielectric layer 28 are fixed to the conductive layer 26.

With this fixing method, both ends of each of the layers 27 and 28 are pushed into the inner side of the conductive layer 26. Since the layers 27 and 28 are tensed, they are not loosen or warped.

Moreover, since the layers 27 and 28 are fixed only by means of the sheet holding plate 30, they are easily replaceable.

Figure 4:
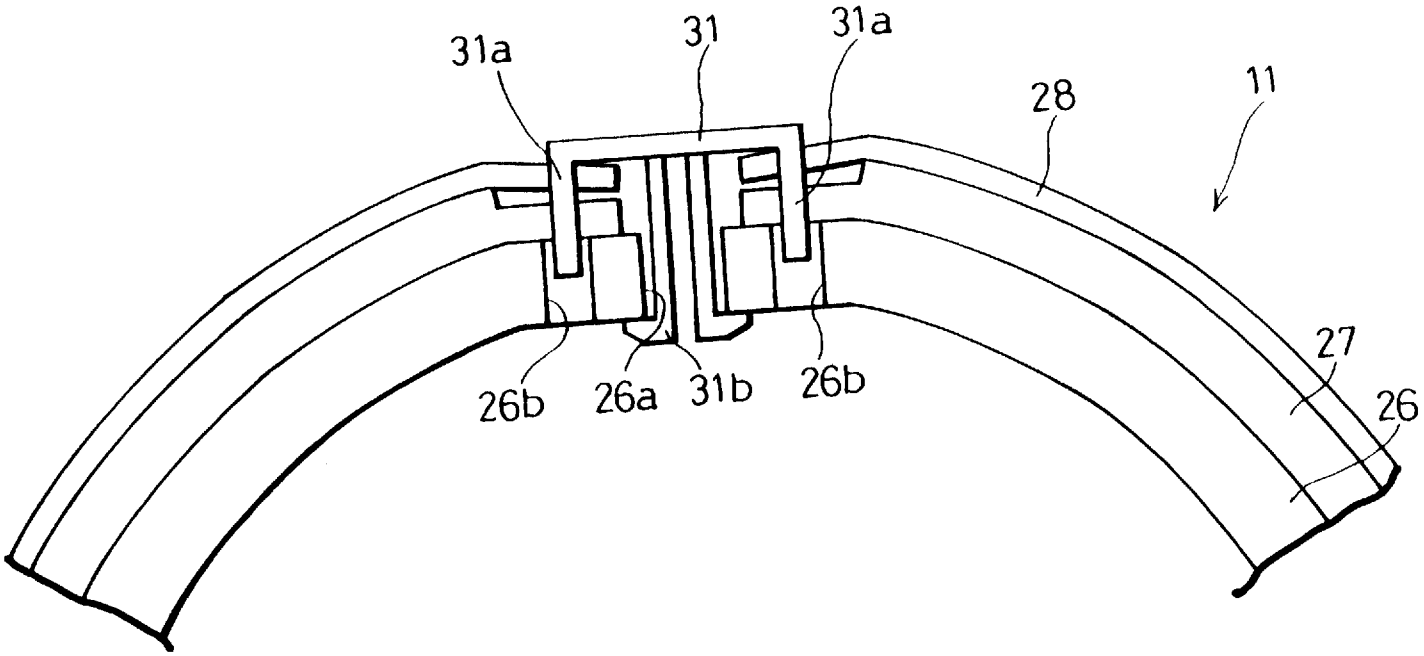
FIG. 4 is another explanatory view showing a coupling state of the conductive layer, the sheets of semi-conductive layer and dielectric layer forming the transfer drum of FIG. 1.

Regarding fixing methods other than the above method, for example, as illustrated in FIG. 4, there is a method in which the layers 27 and 28 are fixed to the conductive layer 26 using a sheet holding member 31 having bosses 31*a* on both ends and a fixing member 31*b* at the center thereof. With this method, the layers 27 and 28 are fixed to the conductive layer 26 by arranging the bosses 31*a* of the sheet holding member 31 to fit into fitting holes 26*b* formed near the ends of the opening 26*a* on the conducting layer 26 and inserting the fixing member 31*b* into the opening 26*a*.

When the layers 27 and 28 are fixed by this method, they are also easily replaced.

Next, how the transfer drum 11 attracts the transfer paper and transfers the toner image to the transfer paper are explained below with reference to FIGS. 5 and 6. Here, it is assumed that a positive voltage is applied to the conductive layer 26 of the transfer drum 11 by the power source section 32.

First, adhesion of the transfer paper P to the transfer drum 11 will be discussed. As illustrated in FIG. 5, the transfer paper P transported to the transfer drum 11 is pressed against the surface of the dielectric layer 28 by the conductive roller 12. Then, the charges accumulated on the semi-conductive layer 27 move to the dielectric layer 28, thereby inducing positive charges on the surface of the dielectric layer 28. As a result, negative charges are induced on a surface of the transfer paper P which is in contact with the dielectric layer 28. Consequently, the transfer paper P electrostatically adheres to the transfer drum 11. The force of adhesion is not varied when the voltage applied to the conductive layer 26 is constant. It is therefore possible to achieve stable adhesion of the transfer paper P to the transfer drum 1.

As described above, since the conductive layer 26 is not charged by atmospheric discharge but is charged by contact, it is possible to apply a lower voltage to the conductive layer 26. According to the results of various experiments, a suitable voltage to be applied to the conductive layer 26 is not higher than +3 kV. More preferably, if the applied voltage is +2 kV, the conductive layer 26 is satisfactorily charged.

The transfer paper P adhering to the transfer drum 11 is transported to a position (transfer position X) where a toner image is transferred to the transfer paper P having a positively charged outer surface by a rotation of the transfer drum 11 in the direction of an arrow.

Next, the transfer process of the transfer paper P is explained below. As illustrated in FIG. 6, toner having negative charge on a surface thereof adheres to the photoreceptor drum 15. When the transfer paper P having positive charge on a surface thereof is transported to the transfer position X, the toner adheres to the surface of the transfer paper P due to a potential difference between the positive charge on the surface of the transfer paper P and the negative charge of the toner. As a result, the toner image is transferred from the photoreceptor drum 15 to the transfer paper P.

The transfer drum 11 and the photoreceptor drum 15 are pressed against each other by pressure so that they are in contact with each other by a predetermined distance in the rotating direction (i.e., the nip length) at the transfer position X. Namely, the transfer efficiency, i.e., image quality is affected by the nip length.

The relationship between the nip length and the image quality is shown in Table 1.

TABLE 1

| Nip Length | 1 | 2 | 3 | 4 | 5 | 6 | 7 | 8 | 9 | 10 |
|---|---|---|---|---|---|---|---|---|---|---|
| Image Quality | x | Δ | ○ | ○ | ○ | ○ | Δ | x | x | x |
| | | unsatisfactory transfer | | | ←→ | | printing blots, etc. | | | |

Unit: mm

○: satisfactory transfer,
Δ: normal transfer,
x: unsatisfactory transfer

As shown in Table 1, satisfactory image quality is obtained by setting the nip length in a range between 2 mm and 7 mm, and more preferably, in a range between 3 mm and 6 mm.

The semi-conductive layer 27 has a volume resistivity of $10^8$ Ω·cm, a thickness of 2 mm to 5 mm, a hardness of 25 to 50 in the unit of ASKER C, to be described later. These values are set in relation with the transfer drum 11 and the photoreceptor drum 15 which are brought into contact with each other by a pressure of 8 kg.

Namely, if the material of the semi-conductive layer 27 is changed, the pressure for bringing the transfer drum 11 and the photoreceptor drum 15 into contact with each other varies. Thus, in order to achieve desired image quality, the thickness and hardness of the semi-conductive layer 27 are varied depending on the material.

In this embodiment, therefore, the nip length is set within an appropriate range by using the semi-conductive layer 27 of the above-mentioned thickness and hardness.

The ASKER C indicates the hardness of a sample which is measured by a hardness measuring device (a macromolecule measuring instrument) produced in accordance with the standard (SRIS 0101) of Japanese Rubber Association. Specifically, the hardness measuring device indicates the hardness of a sample by pressing a ball-point needle designed for hardness measurement against a surface of the sample using a force of a spring and measuring the depth of indentation produced by the needle when the resistive force of the sample and the force of spring balance. With the standard of ASKER C, when the depth of indentation produced by the needle with the application of load of 55 g on the spring becomes equal to the maximum displacement of the needle, the hardness of the sample is indicated as zero degree. Also, when the depth of indentation produced by the application of load of 855 g is zero, the hardness of the sample is indicated as one hundred degree.

If the volume resistivity of the semi-conductive layer 27 is 0 Ω·cm, the surface potential of the transfer drum 11 is lowered before the transfer paper reaches the transfer position X through the conductive roller 12 disposed at the adhesion start position of the transfer paper. In order to prevent the lowering of the surface potential, the semi-conductive layer 27 is arranged to have a predetermined volume resistivity and to function as a capacitor.

The relationship between the volume resistivity and the image quality is shown in Table 2.

TABLE 2

| Volume Resistivity | $10^1$ | $10^2$ | $10^3$ | $10^4$ | $10^5$ | $10^6$ | $10^7$ | $10^8$ | $10^9$ |
|---|---|---|---|---|---|---|---|---|---|
| Image Quality | x | x | x | x | Δ | ○ | ○ | Δ | x ↓ |
| | | ←back transfer→ | | | factory transfer | | | unsatis- | |
| | | | | | | | | | Unit: Ω · cm |

○: satisfactory transfer,
Δ: normal transfer,
x: unsatisfactory transfer

As shown in Table 2, a satisfactory transfer is achieved without a back transfer nor an unsatisfactory transfer when the volume resistivity of the semi-conductive layer 27 is in a range between $10^5$ Ω·cm and $10^8$ Ω·cm. It is more preferable to have a volume resistivity in a range between $10^6$ Ω·cm and $10^7$ Ω·cm.

Therefore, as mentioned in this embodiment, a satisfactory transfer is carried out and satisfactory image quality is obtained when the volume resistivity of the semi-conductive layer 27 is $10^8$ Ω·cm.

In general, the dielectric layer 28 is required to have a high permittivity and holding power of charge. Then, the dielectric layer 28 is formed by polyvinylidene fluoride, and the permittivity is set within a range between 8 and 12. The amount of charge is given by $$C=\epsilon\cdot s/l$$

where C is the amount of charge, ϵ is the permittivity, s is the area of the dielectric layer 28, and l is the thickness thereof.

It is known from the equation that the amount of charge C is decreased and the transfer efficiency is improved as the permittivity ϵ becomes smaller. However, since the amount of charge is decreased, the adhesion force also becomes smaller. It is also understood from the equation that the amount of charge C is increased and the transfer efficiency is lowered as the thickness of the dielectric layer 28 is reduced. However, since the amount of charge C becomes larger, the adhesion force is increased.

It is thus necessary to appropriately set the permittivity ϵ and the thickness l of the dielectric layer 28. The adhesion force of the transfer paper P and the transfer efficiency become ,appropriate when the dielectric layer 28 has the permittivity ϵ in a range between 8 and 12 and the thickness l in a range between 100 μm and 300 μm.

Figure 7:
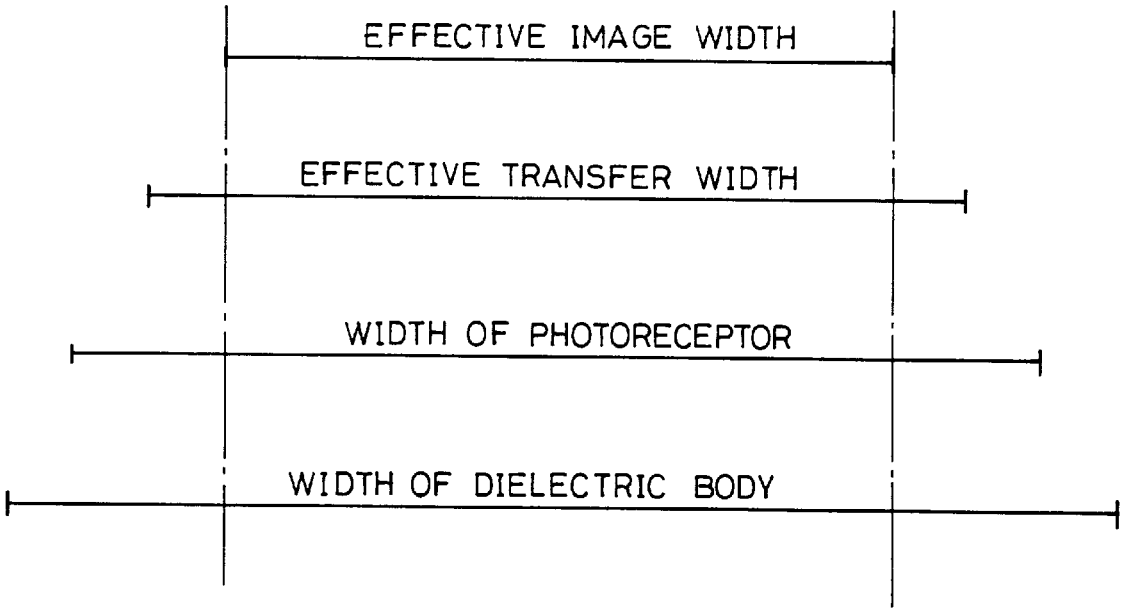
FIG. 7 is an explanatory view showing a comparison between a charged width of the transfer drum of FIG. 1 and an effective image width.

As illustrated in FIG. 7, the width (a dimension in the axis direction) of the dielectric layer 28 of the transfer drum 11 is larger than a width of the photoreceptor tube (aluminum tube 15*a*) constituting the photoreceptor drum 15. The width of the photoreceptor tube is larger than an effective transfer width which is larger than an effective image width (the width of the OPC film 15*b*).

Figure 8:
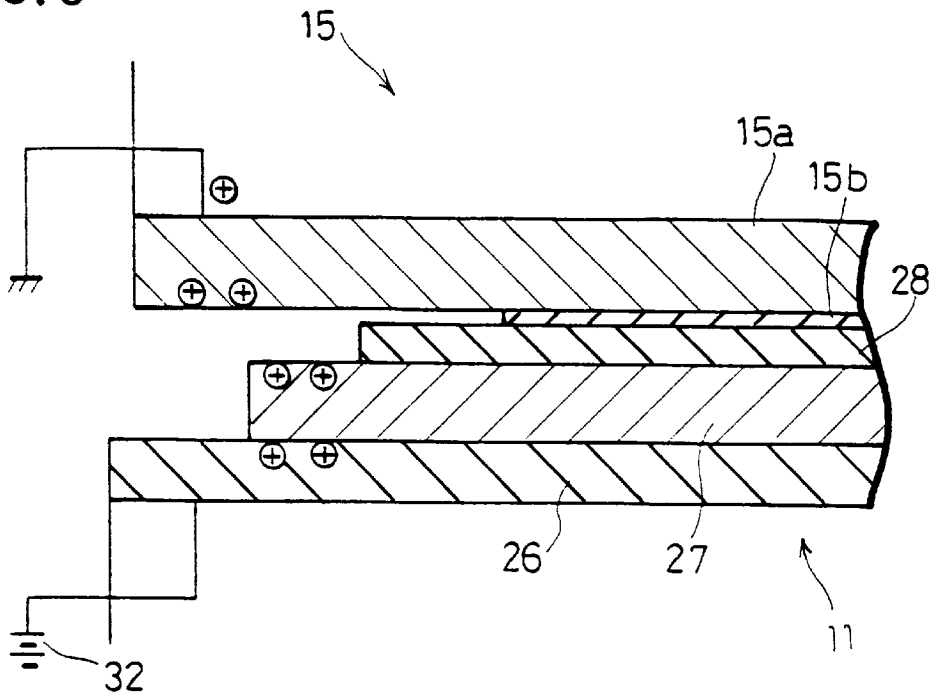
FIG. 8 is an explanatory view showing a relationship between the widths of the respective layers forming the transfer drum and the movement of charge.

As illustrated in FIG. 8, when the widths of the layers 26, 27, 28 of the transfer drum 11 are set so that the conductive layer 26>the semi-conductive layer 27>the dielectric layer 28, there is a possibility that the semi-conductive layer 27 comes into contact with the grounded aluminum tube 15*a* of the photoreceptor drum 15.

Namely, when a positive voltage is applied to the conductive layer 26 by the power source section 32, positive charges are induced on the conductive layer 26 and moved to the surface of the semi-conductive layer 27. At this time, if the grounded aluminum tube 15*a* of the photoreceptor drum 15 and the semi-conductive layer 27 come into contact with each other, all the charges on the semi-conductive layer 27 move to the aluminum tube 15*a*, thereby preventing the induction of positive charges on the surface of the dielectric layer 28. Consequently, the transfer drum 11 fails to attract negatively charged toner adhering to the OPC film 15*b*, resulting in an unsatisfactory transfer.

Figure 9:
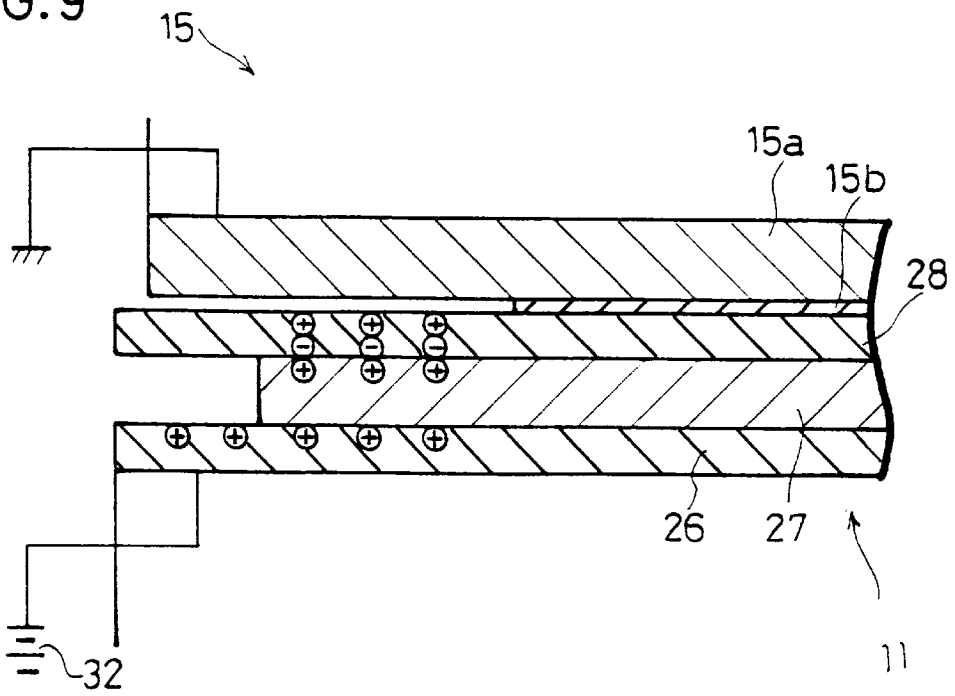
FIG. 9 is another explanatory view showing a relationship between the widths of the respective layers forming the transfer drum and the movement of charge.

It is possible to prevent the semi-conductive layer 27 and the grounded aluminum tube 15*a* from coming into contact with each other and prevent the leakage of charges by arranging the conductive layer 26 and the dielectric layer 28 to have a substantially equal width and the semi-conductive layer 27 to have a width smaller than the width of each of the layers 26 and 28 as shown in FIG. 9.

As a result, the negatively charged toner adhering to the OPC film 15*b* is attracted to the transfer drum 11, preventing an unsatisfactory transfer.

The diameter of the transfer drum 11 is determined so that a sheet of transfer paper is wound around the transfer drum 11 without overlapped portions. Namely, the transfer drum 11 is formed to have a size according to the maximum width or length of transfer paper usable in the present image forming apparatus.

With this configuration, the transfer paper is stably wound around the transfer drum 11, thereby improving the transfer efficiency and the image quality.

Figure 5:
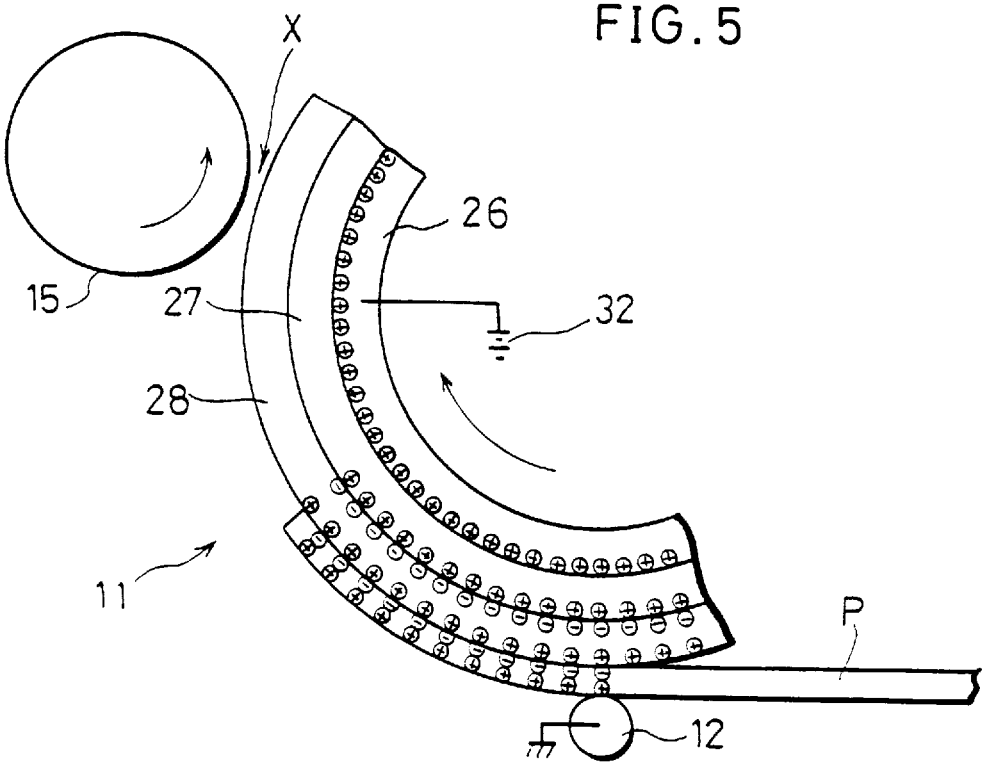
FIG. 5 is an explanatory view showing a charged state of the transfer drum of FIG. 1, and an initial state in which transfer paper is transported to the transfer drum.
Figure 6:
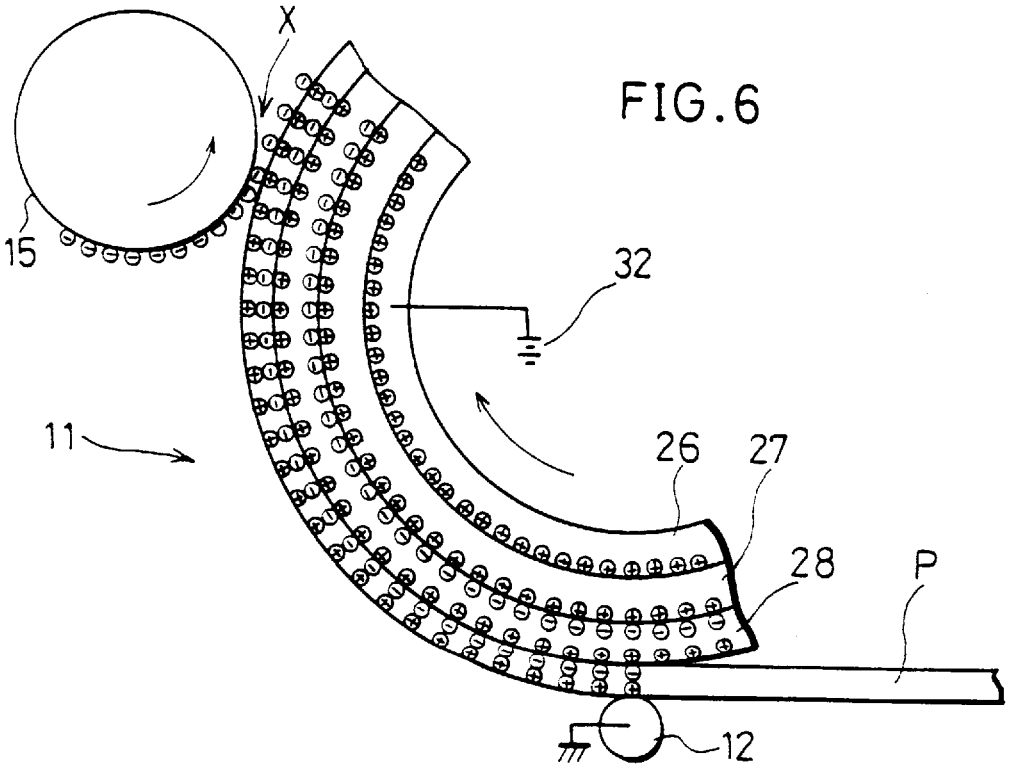
FIG. 6 is an explanatory view showing a charged state of the transfer drum of FIG. 1, and a state in which the transfer paper is transported to a transfer position.

The following description discusses image forming processes in the image forming apparatus having the above-mentioned structure with reference to FIGS. 2, 5 and 6.

First, as illustrated in FIG. 2, when automatically feeding the transfer paper, the transfer paper is fed sheet by sheet to the PF rollers 8 from the feed cassette 5 disposed on the lowest level of the main body. In this case, the transfer paper is sequentially fed from the topmost sheet by the pickup roller 7. The transfer paper which has passed through the PF rollers 8 is curled along a surface shape of the transfer drum 11 by the pre-curl rollers 10.

On the other hand, when manually feeding the transfer paper, the transfer paper is fed sheet by sheet from the manual feed section 6 located on the front side of the main body to the pre-curl rollers 10 by the manual-feed rollers 9. Then, the transfer paper is curled along the surface shape of the transfer drum 11 by the pre-curl rollers 10.

Second, as illustrated in FIG. 5, the transfer paper P which has been curled by the pre-curl rollers 10 is transported to a section between the transfer drum 11 and the conductive roller 12, and charges are induced on an outer surface of the transfer paper P through the outer surface of the semi-conductive layer 27 and an inner surface of the transfer paper P by the charges accumulated on the semi-conductive layer 27 of the transfer drum 11. As a result, the transfer paper P electrostatically adheres to the surface of the transfer drum 11.

Next, as illustrated in FIG. 6, the transfer paper P adhering to the transfer drum 11 is transported to the transfer position X where the transfer drum 11 and the photoreceptor drum 15 are brought into contact with each other by pressure. Then, the toner image is transferred to the transfer paper P by the potential difference between the charge of the toner adhering to the photoreceptor drum 15 and the charge on the surface of the transfer paper P.

At this time, on the photoreceptor drum 15, a series of charging, exposure, development and transfer operations are performed for each color. Thus, the transfer paper P adhering to the transfer drum 11 is moved in a circular course by a rotation of the transfer drum 11. A one-color image is transferred with one rotation of the transfer drum 11, and a full-color image is obtained with the maximum of four rotations. Namely, when producing a black-and-white image or a mono-color image, it is only necessary to have one rotation of the transfer drum 11.

Moreover, when all of the toner images have been transferred to the transfer paper P, the transfer paper P is forced to separate from the surface of the transfer drum 11 by the separating claw 14 which is movable to touch or separate from the circumference of the transfer drum 11, and guided to the fixing guide 22.

The transfer paper P is then guided to the fixing rollers 23 by the fixing guide 22, and the toner image on the transfer paper P is fused and fixed onto the transfer paper P by the heat and pressure of the fixing rollers 23.

The transfer paper P carrying the image fixed thereon is discharged onto the output tray 25 by the discharge roller 24.

As described above, the transfer drum 11 includes the conductive layer 26, the semi-conductive layer 27 and the dielectric layer 28 made of aluminum, urethane foam and polyvinylidene fluoride, respectively, from inside toward outside. With this configuration, when a voltage is applied to the conductive layer 26, the charges are sequentially induced on the conductive layer 26 and the semi-conductive layer 27, and accumulate on the semi-conductive layer 27. When the transfer paper P is transported to the section between the transfer drum 11 and the conductive roller 12, the accumulated charges on the semi-conductive layer 27 move to the transfer paper P. As a result, the transfer paper P electrostatically adheres to the transfer drum 11.

Hence, with the present invention, the adhesion of the transfer paper and the transfer of the image are carried out by the induced charges rather than the injected charges caused by the conventional atmospheric discharge. It is therefore possible to decrease the applied voltage to the conductive layer 26 and the power consumption, and to easily control the voltage. Additionally, although the voltage is varied when charges are injected by the atmospheric discharge, this method prevents such variations.

Since the surface potential of the transfer drum 11 is kept uniform without being influenced by environmental conditions such as moistures and temperature, the transfer efficiency and the image quality are improved.

In comparison with the conventional method in which the surface of the transfer drum 11 is charged by inducing charges thereon by discharges, the surface of the transfer drum 11 is charged in a more stable manner. It is thus possible to stably perform the adhesion of the transfer paper to the transfer drum 11 and the transfer of the image.

Moreover, unlike the conventional structure, there is no need to apply the voltage using a plurality of chargers because the voltage needs to be applied to only one region. It is therefore possible to simplify the apparatus and to reduce the manufacturing cost.

Furthermore, since the transfer drum 11 is charged by contact charging, the electric field is not varied even if the surface of the transfer drum 11 is scratched. Namely, the balance of the electric field is kept even at the scratched section on the surface of the transfer drum 11. Thus, since an unsatisfactory transfer, for example, a blank area does not occur, the transfer efficiency is improved.

In addition, since this method is less influenced by environmental conditions such as the humidity and temperature of the air compared with the method using atmospheric discharge, it is possible to eliminate the surface potential variations of the transfer drum 11, thereby preventing unsatisfactory adhesion of the transfer paper and disorderly images. Consequently, the transfer efficiency and image quality are improved.

Furthermore, since the semi-conductive layer 27 is formed by a semi-conductive resilient body, the adjustment of the hardness of the surface of the transfer drum 11 as well as the adjustment of the nip length of the transfer drum 11 and the photoreceptor drum 15 are easily carried out compared with the case where the semi-conductive layer 27 is made of a rigid body. As a result, the transfer is performed in a stable manner and the image quality is improved.

In this case, since the semi-conductive layer 27 is formed by an inexpensive, easily obtainable urethane foam or silicon, it is possible to decrease the cost of manufacturing the image forming apparatus.

A cylindrical aluminum is used as the conductive layer 26 in this embodiment. However, it is also possible to use other conductive body. Here, although the semi-conductive layer 27 is formed by urethane foam, it is possible to use a resilient body, for example, silicon for the semi-conductive body. In addition, resins, for example, polyethylene terephthalate may be used as a dielectric body for the dielectric layer 28 instead of polyvinylidene fluoride.

[Embodiment 2]

Figure 10:
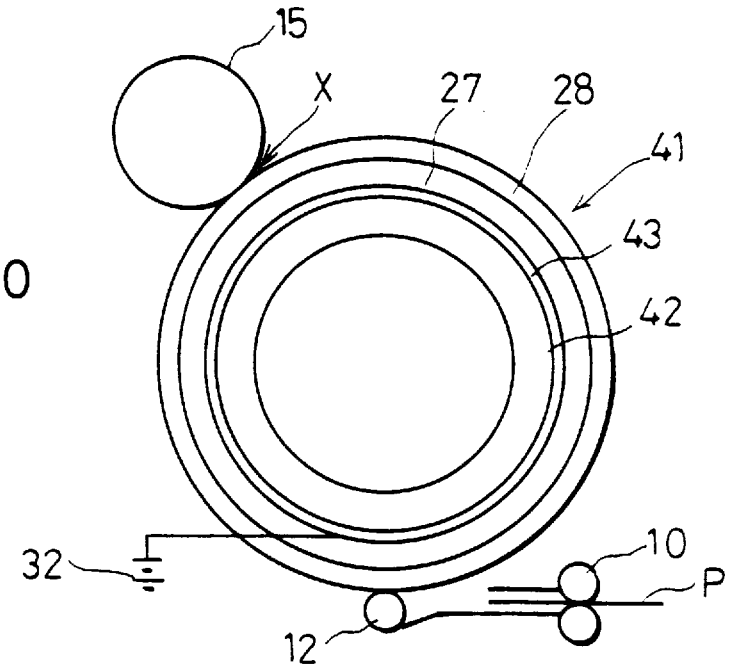
FIG. 10 schematically shows the structure near a transfer drum in an image forming apparatus according to another embodiment of the present invention.

The following description discusses another embodiment of the present invention with reference to FIG. 10. The members having the same function as in Embodiment 1 will be designated by the same code and their description will be omitted.

An image forming apparatus of this embodiment has the same structure as that in Embodiment 1 except the transfer drum 11 shown in FIG. 2. Namely, the present image forming apparatus includes a transfer drum 41 shown in FIG. 10 instead of the transfer drum 11.

The transfer drum 41 includes a cylindrical base member (base layer) 42 formed by a resin on which a conductive thin film layer 43 such as a thin copper or an aluminum film is formed, instead of the conductive layer 26 of the transfer drum 11 shown in FIG. 1 of Embodiment 1. The semi-conductive layer 27 and the dielectric layer 28 are formed in this order on an outer surface of the thin film layer 43.

Similarly to Embodiment 1, by connecting the power source section 32 to the thin film layer 43 and applying a voltage, charges are stably induced on the surface of the dielectric layer 28. As a result, the transfer paper P adheres to the transfer drum 41, and a transfer of the toner image is performed in a stable manner.

Like Embodiment 1, since the layers 27 and 28 are shaped into sheet form and fixed by the sheet holding plate 30, they are easily replaceable.

As described above, by forming the base member 42 of the transfer drum 41 using a resin and providing a conductive body, for example, a thin copper film on the surface thereof, the manufacturing cost is decreased compared with the case in which the conductive layer 26 of Embodiment 1 is used.

[Embodiment 3]

Figure 11:
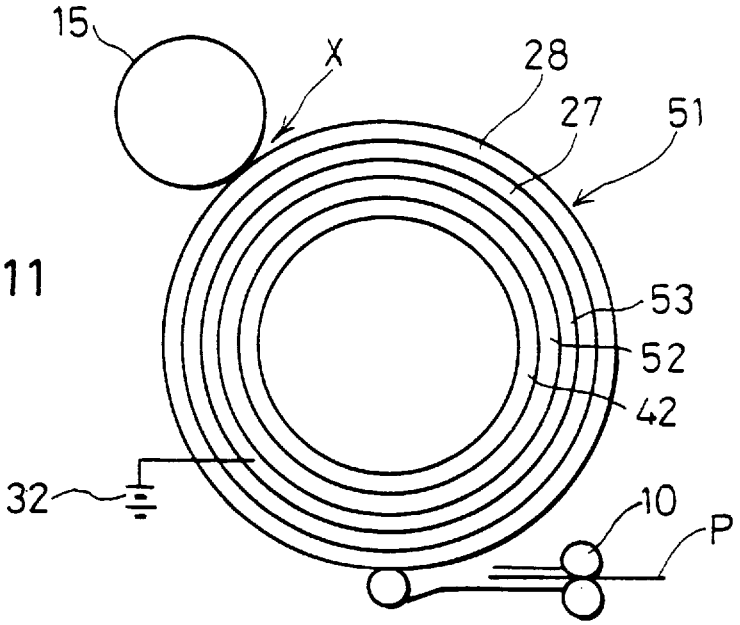
FIG. 11 schematically shows the structure near a transfer drum in an image forming apparatus according to still another embodiment of the present invention.
Figure 12:
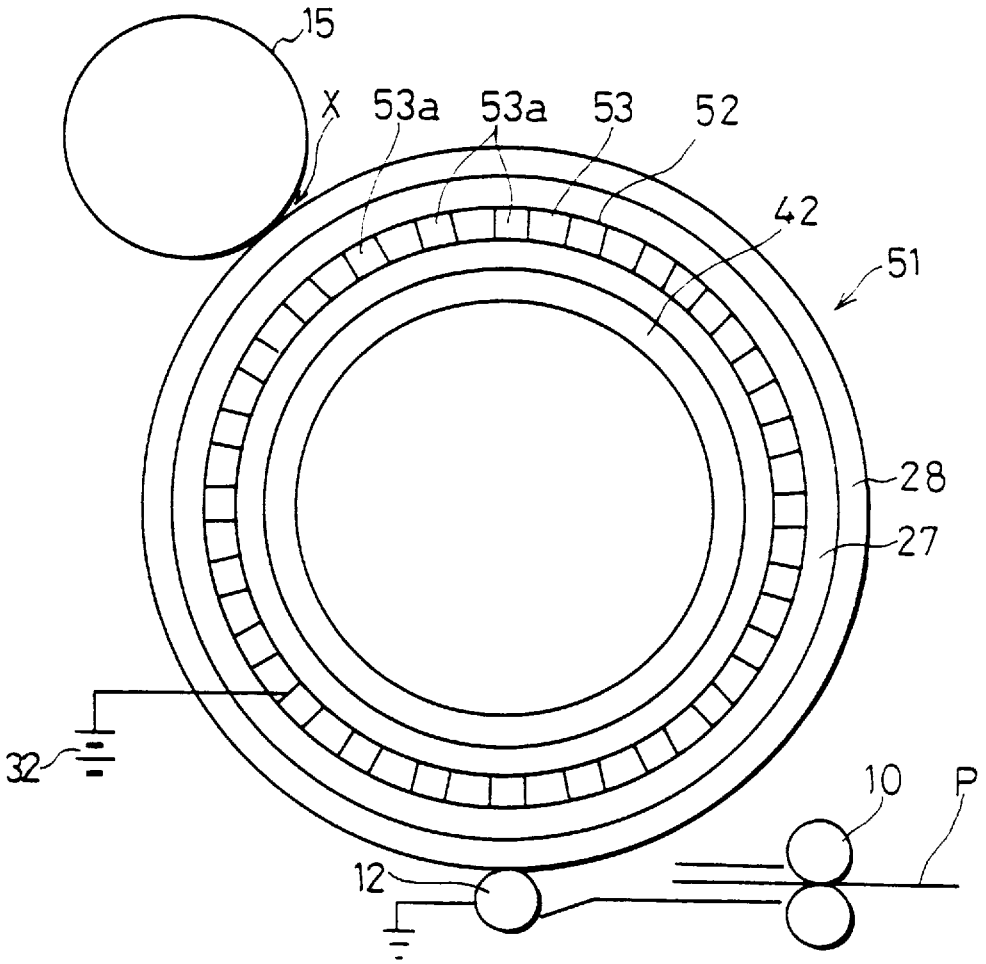
FIG. 12 is an enlarged view of the transfer drum shown in FIG. 11.
Figure 13:
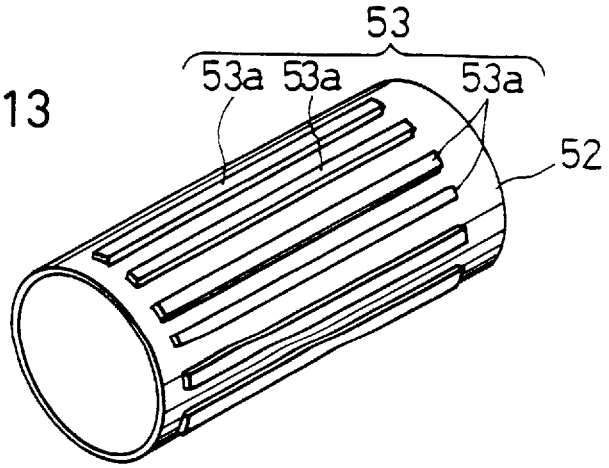
FIG. 13 is a perspective view of an electrode layer of the transfer drum shown in FIG. 11.

The following description discusses another embodiment of the present invention with reference to FIGS. 11 to 13.

The members having the same function as in the above-mentioned embodiments will be designated by the same code and their description will be omitted.

An image forming apparatus of this embodiment has a transfer drum 51 shown in FIG. 11 instead of the transfer drum 11 included in the image forming apparatus shown in FIG. 2 of Embodiment 1.

As illustrated in FIG. 11, the transfer drum 51 uses the base member 42 in the transfer drum 41 of Embodiment 2 as a base member, and a semi-conductive resilient layer 52 on a surface of the base member 42. As illustrated in FIGS. 12 and 13, a discontinuous electrode layer (conductive layer) 53 is formed on a surface of the resilient layer 52 by arranging thereon a plurality of conductive plates (conductive members) 53*a*. For example, copper plates or aluminum plates are arranged at uniform intervals in the circumferential direction of the transfer drum 51.

Additionally, the semi-conductive layer 27 and the dielectric layer 28 are formed in this order on the surface of the electrode layer 53.

Similarly to Embodiment 1, by connecting the power source section 32 to the electrode layer 53 and applying a voltage, charges are stably induced on the surface of the dielectric layer 28. As a result, the transfer paper P adheres to the transfer drum 51, and a transfer of the toner image is carried out in a stable manner.

Similar effects are also obtained by connecting the power source section 32 to the resilient layer 52 and applying a voltage.

Regarding the transfer drum 51 of the above-mentioned structure, since the electrode layer 53 is formed by the conductive plates 53*a* which are separately disposed on the resilient layer 52, the voltage is dropped only in a region of the electrode layer 53 approaching the vicinity of the grounded conductive roller 12. In other regions, since the conductive plates 53*a* are discontinuous, charges between the conductive plates 53*a* do not move, and thereby preventing a lowering of the voltage.

With this configuration, it is possible to prevent a lowering of the surface potential at the transfer position X, and to eliminate an unsatisfactory transfer. As a result, the transfer efficiency and the image quality are improved.

Furthermore, as described above, since the electrode layer 53 as the conductive layer is formed by simply arranging the conductive plates 53*a* at uniform intervals on the surface of the resilient member 42, the cost of manufacturing the transfer drum 51 is reduced. Consequently, the manufacturing cost of the overall apparatus is decreased.

[Embodiment 4]

Figure 14:
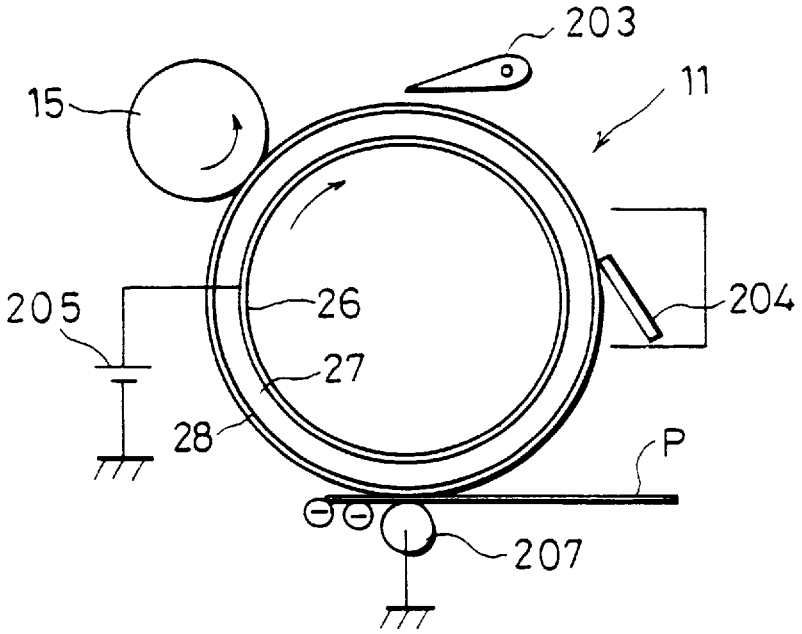
FIG. 14 schematically shows the structure near a transfer drum in an image forming apparatus according to still another embodiment of the present invention.

The following description discusses another embodiment of the present invention with reference to FIG. 14. The members having the same function as in the above-mentioned embodiments will be designated by the same code and their description will be omitted.

This embodiment explains potential-difference producing means capable of enhancing the adhesion effect of the transfer paper P to the transfer drum 11, various modified examples thereof, and the positional relationship between the transfer drum 11 and the potential-difference producing means.

A grounded conductive roller 207 as the potential-difference producing means is mounted in contact with the transfer drum 11 shown in FIG. 14 on an upstream section of the transfer position. Additionally, a separating claw 203 and a cleaning member 204 are provided in close proximity to each other in a downstream section of the transfer position. The separating claw 203 performs a function similar to that of the separating claw 14. The cleaning member 204 removes unwanted toner adhering to the surface of the transfer drum 11. Similar to Embodiment 1, a positive voltage is applied to the inmost conductive layer 26 of the transfer drum 11 by a power source section 205.

Regarding a material for the potential-difference producing means like the conductive roller 207, a fully conductive material is more suitable than a rubber-like semi-conductive material including carbon.

With the above-mentioned structure, since the grounded roller 207 is in contact with the transfer drum 11, a discharge occurs due to a potential difference between the conductive layer 26 and the conductive roller 207. Thus, by simply applying a positive voltage to the conductive layer 26 of the transfer drum 11 from the power source section 205, positive charges accumulate on the surfaces of the conductive layer 26 and the semi-conductive layer 27, and positive charges are also induced on the surface of the dielectric layer 28. Namely, the entire surface of the transfer drum 11 is positively charged.

Even when the transfer paper P is moved between the transfer drum 11 and the conductive roller 207, charges are induced sequentially on the semi-conductive layer 27 and the dielectric layer 28. Then, an amount of negative charge equal to the amount of positive charge induced on the dielectric layer 28 flows to the transfer paper P from the conductive roller 207, and accumulate on a back surface of the transfer paper P which is in contact with the dielectric layer 28. The transfer paper P needs to adhere to the dielectric layer 28 in order to effectively discharge the potential difference.

The relationship between the closeness of the conductive roller 207 and the transfer drum 11 and the adhesion effect of the transfer paper P to the transfer drum 11 is calculated. When the circumferential circle of the conductive roller 207 crosses the circumferential circle of the transfer drum 11, the closeness is given by a length (hereinafter referred to as the crossover amount) which is calculated by subtracting a distance between the center points of the circumferential circles from the sum of the radii thereof. A radius of the circumferential circle of the conductive roller 207 is equal to a radius of the conductive roller 207. Similarly, a radius of the circumferential circle of the transfer drum 11 is equal to a radius of the transfer drum 11. Table 3 shows the crossover amount and the corresponding adhesion effect of the transfer paper P.

TABLE 3

| Crossover Amount (mm) | −0.5 or less | 0.0 | 0.5 | 1.0 | 2.0 | 3.0 or more |
|---|---|---|---|---|---|---|
| Adhesion Effect | x | ○ | ⊙ | ⊙ | ○ | Δ |

x: substantially no effect,
Δ: small effect,
○: normal effect,
⊙: great effect

As shown in Table 3, the adhesion effect of the transfer paper P is obtained when the crossover amount is in a range between 0.0 mm and 2.0 mm, and the adhesion effect is enhanced particularly when the crossover amount is in a range between 0.5 mm and 1.0 mm.

In order to facilitate discharging due to the potential difference between the conductive layer 26 and the conductive roller 207, the surface of the conductive roller 207 may have irregularities of around several $\mu$m in height. With this arrangement, the curvature of the surface of the conductive roller 207 abruptly changes at the irregularities. As a result, the density of the lines of electric force is increased, and the strength of electric field on the surface of the transfer drum 11 is enhanced.

Table 4 shows the relationship between the applied voltage to the transfer drum 11 and the adhesion effect of the transfer paper P when the surface of the conductive roller 207 is mechanically embossed with a raised and depressed pattern.

TABLE 41

| Applied Voltage to Transfer Drum(KV) | 0.5 | 1.0 | 1.5 | 2.0 | 2.5 |
|---|---|---|---|---|---|
| Adhesion Effect of Normal Surface | x | x | Δ | ○ | ○ |
| Adhesion Effect of Embossed Surface | x | Δ | ○ | ○ | ○ |

x: substantially no effect,
Δ: small effect,
○: normal effect,
⊙: great effect

As shown in Table 4, in comparison with the case where the surface of the conductive roller 207 was not embossed, more effective discharges were carried out even when the applied voltage had a lowered value, and the adhesion effect of the transfer paper P was enhanced. A sand blast treatment may also be performed for mechanically producing the raised and depressed pattern on the surface of the conductive roller 207.

Moreover, since the conductive roller 207 is in contact with the transfer drum 11, the conductive roller 207 also functions as charge removing means for removing charges remaining on the dielectric layer 28 after the transfer process. The charge removing effect varies depending on a difference in height between the raised and depressed parts even if a uniform voltage is applied to the transfer drum 11. Table 5 shows the relationship between the charge removing effect and the difference in height between the raised and depressed parts.

TABLE 5

| Difference in Height (μm) | 0.0 | 4.0 | 10.0 | 15.0 | 20.0 or more |
|---|---|---|---|---|---|
| Charge Removing Effect | ○ | ⊙ | ⊙ | ○ | x |

x: substantially no effect,
Δ: small effect,
○: normal effect,
⊙: great effect

As shown in Table 5, a satisfactory charge removing effect is produced when the difference in height between the raised and depressed parts of the surface of the conductive roller 207 is in a range between 0.0 μm and 15.0 μm, and more preferably in a range between 4.0 μm and 10.0 μm. At present, since toner generally has a particle diameter of around 10 μm, it is possible to eliminate the possibility that the toner remains in the depressed parts by arranging the difference in height between the raised and depressed parts to be not greater than 10.0 μm.

Furthermore, since the conductive roller 207 is designed to rotate together with the rotation of the transfer drum 11 while being pressed by the transfer drum 11. It is therefore possible to omit a driving source for the charge removing means. Consequently, even when the structure is simplified, residual charges on the surface of the transfer drum 11 are satisfactorily removed, enabling successive adhesion of sheets of transfer paper P to the surface of the transfer drum 11.

[Embodiment 5]

Figure 15:
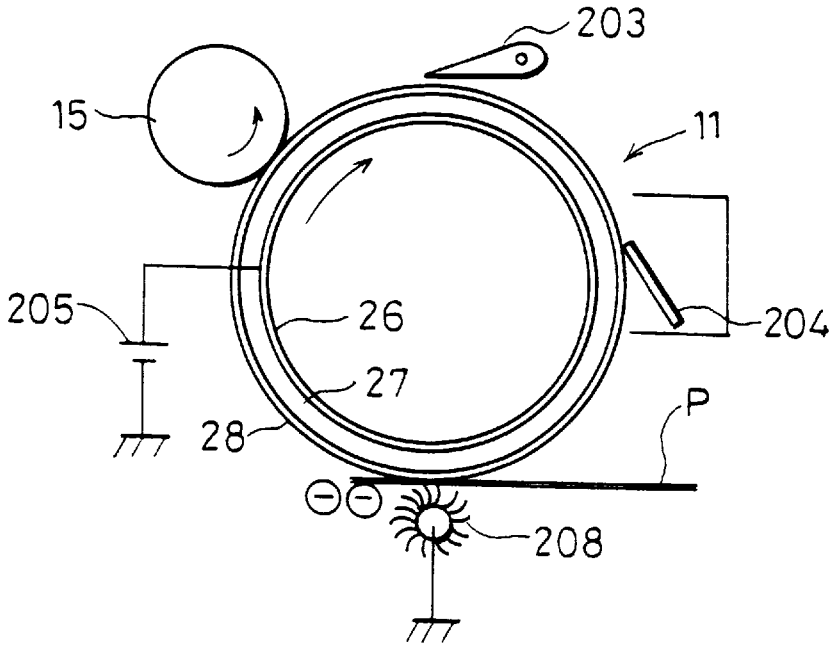
FIG. 15 schematically shows the structure of an image forming apparatus according to still another embodiment of the present invention in which a rolling brush is used as potential-difference producing means.

The following description discusses another embodiment of the present invention with reference to FIG. 15. The members having the same function as in the above-mentioned embodiments will be designated by the same code and their description will be omitted.

As illustrated in FIG. 15, an image forming apparatus of this embodiment includes a rolling brush 208 as the grounded potential-difference producing means instead of the conductive roller 207 explained in Embodiment 4. The rolling brush 208 has a width substantially equal to the width of the transfer drum 11 and is brought into contact with the transfer drum 11 by pressure. Like the conductive roller 207, the rolling brush 208 is designed to rotate together with the rotation of the transfer drum 11.

Regarding a material for the rolling brush 208, for example, conductive materials such as stainless fibers, carbon fibers and copper-dyed acrylic fibers are used.

Since the grounded rolling brush 208 is in contact with the transfer drum 11, discharges occur due to the potential difference between the conductive layer 26 and the rolling brush 208. The principle of the charging of the transfer drum 11 and the transfer paper P is exactly the same as the charging of the conductive roller 207.

The relationship between the closeness of the rolling brush 208 and the transfer drum 11 and the adhesion effect of the transfer paper P to the transfer drum 11 is calculated. When the circumferential circle of the rolling brush 208 in a normal state crosses the circumferential circle of the transfer drum 11, the closeness thereof is indicated by a length (hereinafter referred to as the crossover amount) which is calculated by subtracting a distance between the center points of the circumferential circles from the sum of the radii thereof. Table 6 shows the crossover amounts and the corresponding adhesion effects of the transfer paper P.

TABLE 6

| Crossover Amount (mm) | −0.5 | 0.0 | 0.5 | 1.0 | 2.0 | 3.0 |
|---|---|---|---|---|---|---|
| Adhesion Effect | x | ○ | ⊙ | ⊙ | ⊙ | ⊙ |

x: substantially no effect,
Δ: small effect,
○: normal effect,
⊙: great effect

It was confirmed from Table 6 that the adhesion effect of the transfer paper P was obtained when the crossover amount was in a range between 0.0 mm and 3.0 mm, and the adhesion effect was enhanced particularly when the crossover amount was in a range between 0.5 mm and 3.0 mm.

When the transfer paper P is fed to the transfer drum 11, negative charges flow from the rolling brush 208 to the transfer paper P and accumulate on a back surface thereof which is in contact with the dielectric layer 28 whereupon positive charges have been induced. After the transfer process, the residual charges on the dielectric layer 28 move to the ground through the rolling brush 208, thereby removing the charges on the transfer drum 11. In order to efficiently move the charges, it is necessary to set the resistance of the rolling brush 208 and the number of sticks forming the brush 208 per square cm (hereinafter referred to as the brush density) to optimum values.

Then, the relationship between the value of resistance of the rolling brush 208 and the charge removing effect was studied. The results are given in Table 7. Moreover, the relationship between the brush density and the charge removing effect was examined. The results are shown in Table 8.

TABLE 7

| Brush Resistance (KΩ) | 70 or more | 60 | 50 | 40 | 36 | 20 | 10 | 5 or less |
|---|---|---|---|---|---|---|---|---|
| Charge Removing Effect | x | Δ | Δ | ○ | ⊙ | ⊙ | ⊙ | ⊙ |

x: substantially no effect,
Δ: small effect,
○: normal effect,
⊙: great effect

TABLE 8

| Number of Sticks Per Square cm (number/cm$^2$) | 5000 | 10000 | 15000 | 20000 | 25000 |
|---|---|---|---|---|---|
| Charge Removing Effect | Δ | Δ | ○ | ⊙ | ⊙ |

x: substantially no effect,
Δ: small effect,
○: normal effect,
⊙: great effect

It was confirmed from Table 7 that the value of resistance of the rolling brush 208 needed to be not larger than 40 kΩ, more preferably not larger than 36 kΩ.

It was also confirmed from Table 8 that the brush density needed to be not smaller than 15000/cm$^2$, more preferably set to 20000/cm$^2$.

As described above, with the use of the rolling brush 208 of this embodiment, effective discharges are performed on the transfer drum 11. As a result, the transfer paper P adheres to the transfer drum 11 in a stable manner.

[Embodiment 6]

Figure 16:
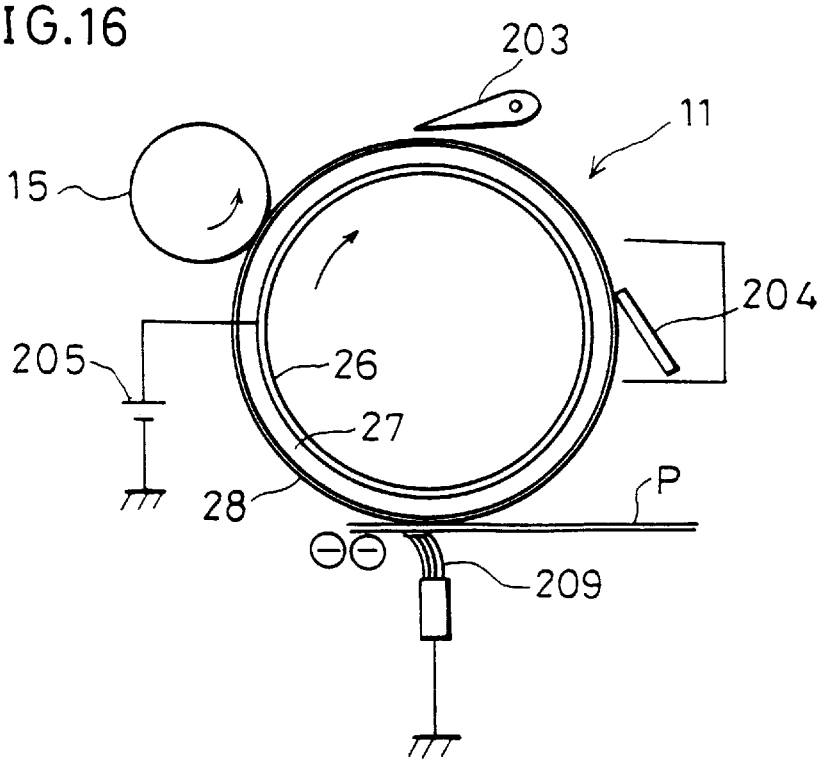
FIG. 16 schematically shows the structure of an image forming apparatus according to still another embodiment of the present invention in which a brush is used as potential-difference producing means.

The following description discusses another embodiment of the present invention with reference to FIG. 16. The members having the same function as in the above-mentioned embodiments will be designated by the same code and their description will be omitted.

As illustrated in FIG. 16, an image forming apparatus of this embodiment includes a brush 209 as the grounded potential-difference producing means instead of the conductive roller 207 explained in Embodiment 4. The brush 209 has a width substantially equal to the width of the transfer drum 11 and is brought into contact with the transfer drum 11 by pressure. Regarding a material for the brush 209, for example, conductive materials such as stainless fibers, carbon fibers, copper-dyed acrylic fibers, ST conductive non-woven cloth, and conductive sheets are used.

Since the grounded brush 209 is in contact with the transfer drum 11, discharges occur due to the potential difference between the conductive layer 26 and the brush 209, and the transfer drum 11 and the transfer paper P are charged. The principle of the charging of the transfer drum 11 and the transfer paper P is exactly the same as the charging of the conductive roller 207.

The relationship between the degree of closeness of the brush 209 and the transfer drum 11 and the adhesion effect of the transfer paper P to the transfer drum 11 is calculated. When the brush 209 in a normal state crosses the circumferential circle of the transfer drum 11, the degree of closeness thereof is indicated by a length of a part of the brush 209 which goes inside the circumferential circle (hereinafter referred to as the crossover amount). Table 9 shows the crossover amounts and the corresponding adhesion effects of the transfer paper P.

TABLE 9

| Crossover Amount (mm) | −0.5 | 0.0 | 0.5 | 1.0 | 2.0 | 3.0 |
|---|---|---|---|---|---|---|
| Charge Removing Effect | x | ○ | ⊙ | ⊙ | ⊙ | ⊙ |

x: substantially no effect, Δ: small effect,
○: normal effect, ⊙: great effect

It was confirmed from Table 9 that the adhesion effect of the transfer paper P was obtained when the crossover amount was in a range between 0.0 mm and 3.0 mm, and the adhesion effect was enhanced particularly when the crossover amount was in a range between 0.5 mm and 3.0 mm.

When the transfer paper P is fed to the transfer drum 11, negative charges flow from the brush 209 to the transfer paper P and accumulate on a back surface thereof which is in contact with the dielectric layer 28 whereupon positive charges have been induced. After the transfer process, the residual charges on the dielectric layer 28 move to the ground through the brush 209, thereby removing the charges on the transfer drum 11. In order to efficiently move the charges, it is necessary to set the resistance of the brush 209 and the pitch of thin sticks forming the brush 209 (hereinafter referred to as the brush electrode pitch) to suitable values.

In order to obtain suitable values, the relationship between the value of resistance of the brush 209 and the charge removing effect was studied. The results are given in Table 10. Moreover, the relationship between the brush electrode pitch and the charge removing effect was examined. The results are shown in Table 11.

TABLE 10

| Brush Resistance (KΩ) | 70 or more | 60 | 50 | 40 | 36 | 20 | 10 | 5 or less |
|---|---|---|---|---|---|---|---|---|
| Charge Removing Effect | x | Δ | Δ | ○ | ⊙ | ⊙ | ⊙ | ⊙ |

x: substantially no effect, Δ: small effect,
○: normal effect, ⊙: great effect

TABLE 11

| Electrode Pitch (mm) | 6.0 or more | 3.0 | 2.0 | 1.6 | 0.5 | 0.3 or less |
|---|---|---|---|---|---|---|
| Charge Removing Effect | x | Δ | ○ | ⊙ | ⊙ | ⊙ |

x: substantially no effect, Δ: small effect,
○: normal effect, ⊙: great effect

It was confirmed from Table 10 that the value of resistance of the brush 209 needed to be not larger than 40 kΩ, more preferably not larger than 36 kΩ.

It was also confirmed from Table 10 that the brush electrode pitch needed to be not larger than 2.0 mm, more preferably not larger than 1.6 mm.

As described above, with the use of the brush 209 of this embodiment, effective discharges are performed on the transfer drum 11. As a result, the transfer paper 11 adheres to the transfer drum 11 in a stable manner.

[Embodiment 7]

Figure 17:
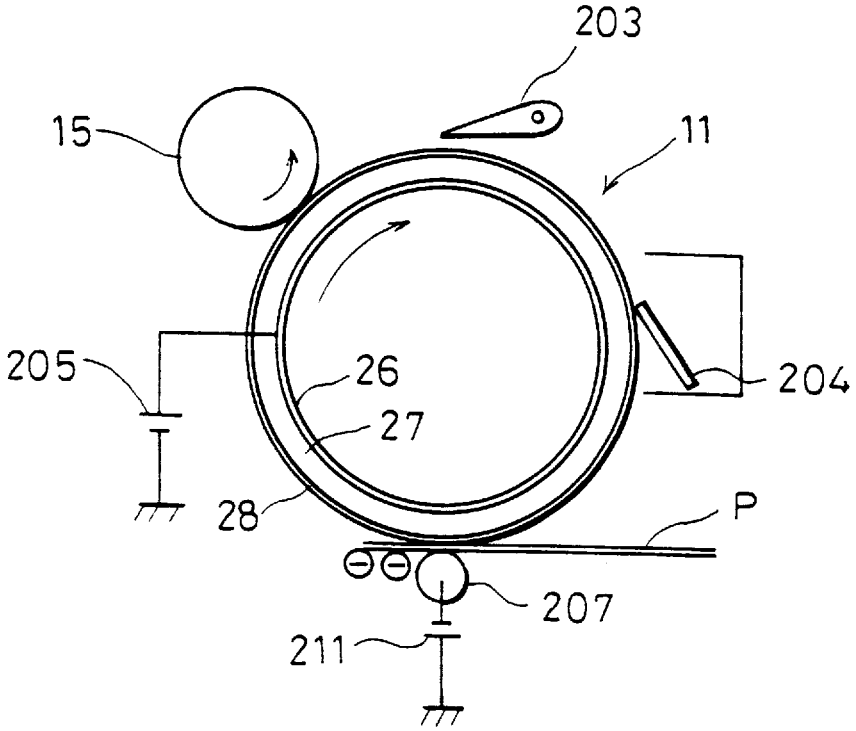
FIG. 17 schematically shows the structure near a transfer drum in an image forming apparatus according to still another embodiment of the present invention.

The following description discusses another embodiment of the present invention with reference to FIG. 17. The members having the same function as in the above-mentioned embodiments will be designated by the same code and their description, will be omitted.

An image forming apparatus of this embodiment includes a power source section 211 for applying to the conductive roller 207 of Embodiment 4 a negative voltage opposite to the voltage applied to the conductive layer 26. Here, it is not necessarily to use the conductive roller 207 as the potential-difference producing means, and thus the conductive roller 207 may be replaced with the rolling brush 208 or the brush 209.

Denoting a charge which flows from the conductive roller 207 to the transfer paper P transported to the section between the transfer drum 11 and the conductive roller 207 as q and denoting an electric field generated by the application of voltage to the conductive layer 26 as E, an adhesion force F exerted on the transfer paper P is given by F=qE. The amount of charge q varies depending on the potential difference between the conductive layer 26 and the conductive roller 207. However, if the conductive roller 207 is grounded, the amount of charge q is limited by an optimum transfer voltage.

More specifically, in order to enhance the adhesion effect of the transfer paper P, it is necessary to increase the electric field E and increase the charge on the transfer paper P by raising the voltage applied to the conductive layer 26. However, when the applied voltage becomes excessively high, it is known that a back transfer phenomenon in which the toner returns to the photoreceptor drum 15 from the transfer paper P occurs. Therefore, when the conductive roller 207 is grounded, it is necessary to limit the applied voltage to the optimum transfer voltage and to restrain the adhesion effect of the transfer paper P in order to prevent an unsatisfactory transfer due to the excessively high applied voltage.

Then, as mentioned in this embodiment, it is possible to apply to the potential-difference producing means such as the conductive roller 207 a voltage opposite to the voltage applied to the conductive layer 26 so as to increase the potential difference between the conductive layer 26 and the conductive roller 207 and generate an amount of charge q sufficient for producing the adhesion effect of the transfer paper P.

With this arrangement, in fact, it becomes possible to separate an adhesion voltage of the transfer paper P and a transfer voltage of toner. For example, assuming that there is a need to have a potential difference of +4 kV between the conductive layer 26 and the conductive roller 207 for achieving satisfactory adhesion of the transfer paper P and that a voltage of +2 kV needs to be applied to the conductive layer 26 as the optimum transfer voltage, a necessary potential difference between the conductive layer 26 and the conductive roller 207 is obtained by applying a voltage of −2 kV to the conductive roller 207.

As described above, by providing the power source section 211 of opposite polarity separately from other power source, a satisfactory adhesion effect is produced without increasing the transfer voltage. As a result, the stable adhesion of the transfer paper P is always achieved even when the number of a copies produced increase.

[Embodiment 8]

Figure 18:
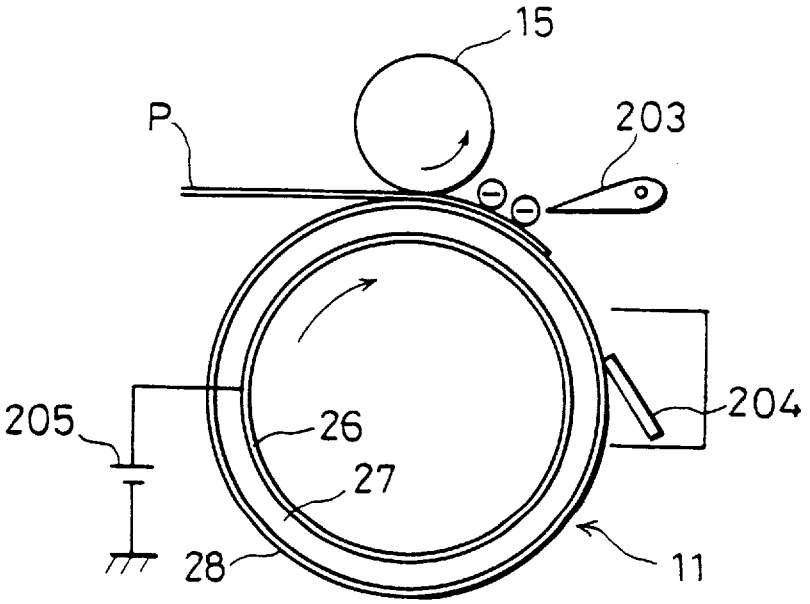
FIG. 18 schematically shows the structure of an image forming apparatus according to still another embodiment of the present invention in which a photoreceptor drum is used as potential-difference producing means.
Figure 19:
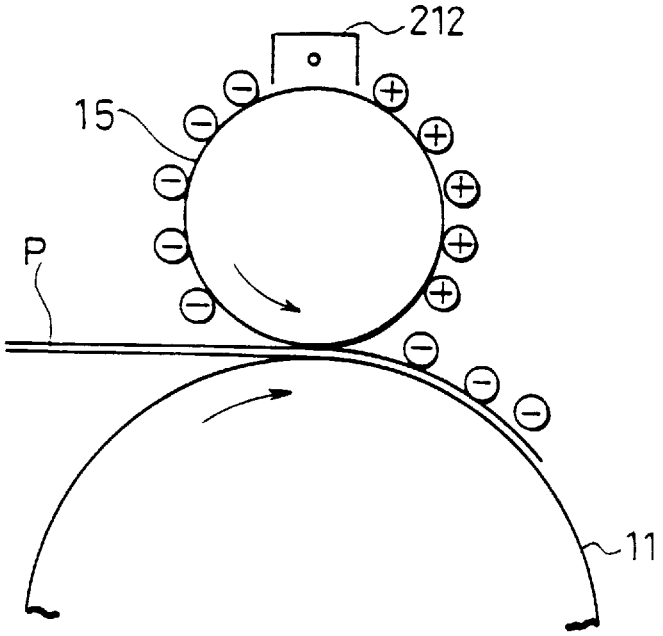
FIG. 19 is an explanatory view depicting a charged state of the photoreceptor drum after a transfer process in the image forming apparatus of FIG. 18.
Figure 20:
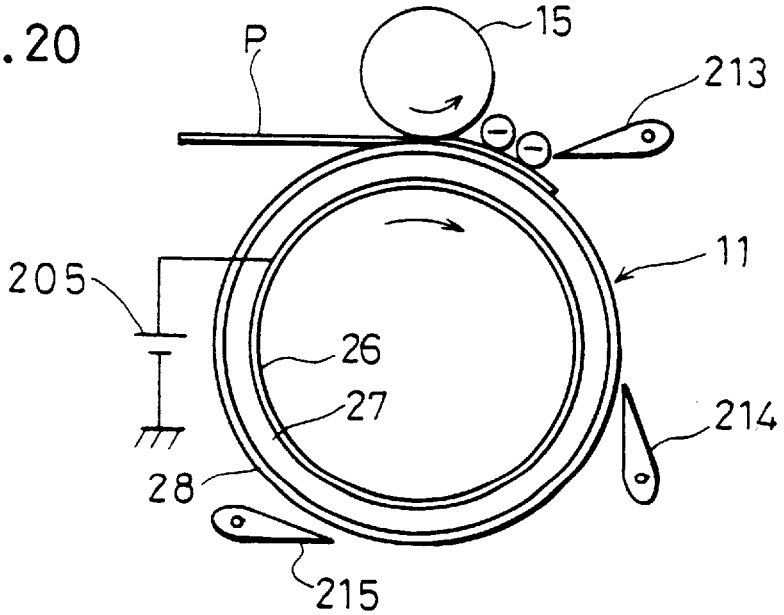
FIG. 20 is an explanatory view showing variations of the separating position of the transfer paper in the image forming apparatus of FIG. 18.

The following description discusses another embodiment of the present invention with reference to FIGS. 18 to 20. The members having the same function as in the above-mentioned embodiments will be designated by the same code and their description will be omitted.

An image forming apparatus of this embodiment does not have the above-mentioned conductive rollers 12, 207, the rolling brush 208 and the brush 209 as the potential-difference producing means, and arranges the photoreceptor drum 15 to function as the potential-difference producing means as shown in FIG. 18. With this arrangement, the transfer paper P is not transported to the section between the potential-difference producing means and the transfer drum 11, but is directly transported to the section between the photoreceptor drum 15 and the transfer drum 11. As mentioned in Embodiment 1, the photoreceptor drum 15 and the transfer drum 11 are brought into contact with each other by a pressure of about 8 kg for optimizing the transfer efficiency and the image quality.

With this structure, since the photoreceptor drum 15 is grounded like the above-mentioned potential-difference producing means and is brought into contact with the transfer drum 11, a potential difference is produced between the photoreceptor drum 15 and the conductive layer 26 to which a positive voltage is applied. Here, since the potential-difference producing means is a conductive body, a current equivalent to an amount of charge retained on the transfer paper P flows through the potential-difference producing means. However, when the potential-difference producing means is the photoreceptor drum 15, unlike the above-mentioned potential-difference producing means, an equal amount of negative charge of opposite polarity to the positive charge on the surface of the dielectric layer 28 is induced on the surface of the photoreceptor drum 15. The negative charge induced on the photoreceptor drum 15 moves to the transported transfer paper P. As a result, the transfer paper P is negatively charged, and adheres to the transfer drum 11 whose surface is positively charged.

The movement of negative charge from the photoreceptor drum 15 to the transfer paper P occurs not only when the grounded photoreceptor 15 is brought into contact with the transfer drum 11 whose surface is positively charged, but also when the negatively charged toner is transferred to the transfer paper P from the developed photoreceptor drum 15. It is therefore possible to provide an adhesion process of attracting the transfer paper P to the transfer drum 11 while inducing negative charges on the surface of the transfer drum 15 by bringing the photoreceptor drum 15 and the transfer drum 11 into contact with each other, and to turn the transfer drum 11 at least one rotation for the adhesion process. It is also possible to perform the transfer process and the adhesion process simultaneously by directly feeding the transfer paper P to the contact position between the developed photoreceptor drum 15 and the transfer drum 11.

Meanwhile, when the negative charge is moved to the transfer paper P from the photoreceptor drum 15, as illustrated in FIG. 19, the positive charge remains on the surface of the photoreceptor drum 15. However, like the usual charge removing process, it is possible to remove the positive charge remaining on the surface of the photoreceptor drum 15 using a charging mechanism 212 such as a charge removing lamp, a corona charging method and a contact charging method, and to always start the next cycle of operations under the same conditions.

Therefore, when the photoreceptor drum 15 functions as the potential-difference producing means, there is no need to add any extra structures, providing the image forming apparatus at the lowest cost in the above-mentioned embodiments. Moreover, if the transfer process and the adhesion process are performed simultaneously, the transport path of the transfer paper P is significantly shortened and the printing speed is particularly increased when images are printed in one color. In this case, as illustrated in FIG. 20, if a separating claw 213 is disposed just after the transfer point of the transfer drum 11 and if the adhesion point, the transfer point and the separating point are located at the same position, the effect of decreasing the transport path of the transfer paper P is most enhanced. Additionally, the effects of decreasing the transport path of the transfer paper P and increasing the printing speed are also produced when performing full-color printing.

Furthermore, when calculating the location of the separating point using a rotation angle of the transfer drum 11 from the transfer point, the separating point can be located in any positions in a downstream area which lies within about 180° from the transfer point (see the installation positions of the separating claws 214 and 215). As a result, since the freedom of positioning the respective members is increased,. the image forming apparatus is easily designed.

[Embodiment 9]

The following description discusses another embodiment of the present invention with reference to FIGS. 21 to 25. The members having the same function as in the above-mentioned embodiments will be designated by the same code and their description will be omitted.

A full-color copying machine (hereinafter just referred to as the copying machine) as an image forming apparatus of this embodiment is capable of copying an image onto a form (document) commonly used for clerical work, a plastic sheet, a post card, an envelope or a label (hereinafter just referred to as the transfer paper) as well as onto a special copy sheet (so-called copy paper or ordinary paper).

Figure 22:
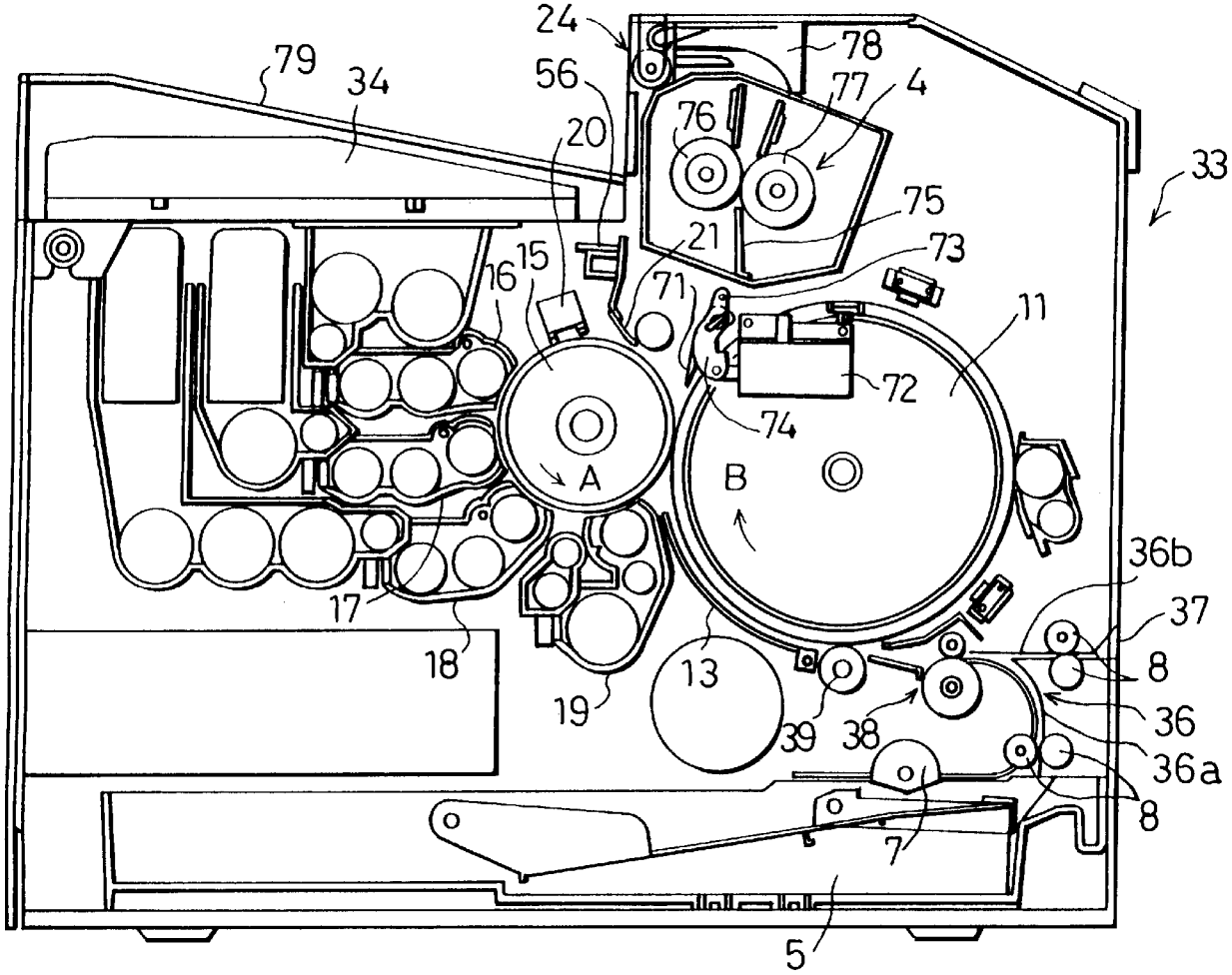
FIG. 22 is a front view schematically showing the structure of a copying machine including the transfer drum shown in FIG. 21.

As illustrated in FIG. 22, the copying machine includes a unit section 34 in an upper part of a main body 33 of the copying machine. The unit section 34 is formed by a scanner unit and a laser driver unit (both of them are not shown). The scanner unit includes a lamp unit, mirrors, a lens unit, a CCD (charge coupled device) sensor and so on (none of them are shown). The scanner unit illuminates a document placed on a document platen (not shown) by the lamp unit, guides the resulting reflected light to a light receiving surface of the CCD sensor through the mirrors and the lens unit, and reads it as electric signals. The image data of the document thus read as electric signals is processed in a predetermined manner by an image processing system (not shown), and sent to the laser driver unit.

The laser driver unit includes a semiconductor laser, a polygon mirror, and an f-θ lens (none of them are shown). The semiconductor laser emits laser light according to input image data. The polygon mirror deflects the laser light at a constant angular velocity. The f-θ lens makes a correction so that the laser light which has been deflected at a constant angular velocity is deflected at a constant angular velocity on the photoreceptor drum 15.

The laser light emitted by the laser driver unit of the unit section 34 is applied to the photoreceptor drum (toner-image carrying body) 15 which is rotatable in the direction of arrow A of FIG. 22 so as to form an electrostatic latent image on the photoreceptor drum 15. Also, disposed above the cleaning blade 21 is an eraser 56 which uniformly irradiates the surface of the photoreceptor drum 15 to remove the residual charges thereon by neutralization so as to bring the electric potential of the photoreceptor drum 15 into an initial state.

A transfer-paper transport path 36 is formed on a paper feeding side when viewing from the transfer drum 11. Formed in the transfer-paper transport path 36 are a sheet transport path 36*a* and a manual-feed transport path 36*b* which join together. The feed cassette (storage member) 5 for storing transfer paper P is provided on an upstream section of the sheet transport path 36*a*. Disposed on the sheet transport path 36*a* are the pickup roller 7 and PF rollers 8 for feeding the transfer paper P. The pickup roller 7 feeds one sheet at a time from the topmost sheet of the transfer paper P stored in the feed cassette 5 by one rotation.

Formed on the front face of the main body 33 of the copying machine is an opening as a manual-feed section 37 through which the transfer paper P is manually fed. The manual-feed section 37 is located on an upstream section of the manual-feed transport path 36*b*. Similar to the sheet transport path 36*a*, the manual-feed transport path 36*b* includes PF rollers 8. If an envelope is desired to be inserted, it is possible to install a manual-feed guide (not shown) in the manual-feed section 37. A transport device is formed by the transfer-paper transport path 36, the PF rollers, etc.

A pair of register rollers 38 are disposed in the vicinity of a lowest section of the transfer drum 11 in a downstream section of the transfer-paper transport path 36. The pair of register rollers 38 feed the transfer paper P to the transfer drum 11 at a predetermined time, and curl the transfer paper P in an arc as to be described later.

The transfer drum 11 is formed by an insulating body and its surface is formed by a dielectric body. Disposed inside the transfer drum 11 is a charger (not shown) for applying a high voltage to the transfer drum 11. When a high voltage is applied to the transfer drum 11 from the inside by the charger, charges accumulate on the insulating body, thereby inducing charges on the surface of the dielectric body. The transfer drum 11 attracts the transfer paper P so that it is wound around the transfer drum 11 by electrostatic adhesion. Charges are induced on the surface of the transfer paper P held on the surface of the transfer drum 11 by the charges on the transfer drum 11. The amount of charge on the surface of the transfer paper P is set larger than that of a toner image on the photoreceptor drum 15.

Disposed below the transfer drum 11 are a grounded transfer roller 39 for pressing the transfer paper P fed from the pair of register rollers 38 against the transfer drum 11 so that the transfer paper P is wound around the surface of the transfer drum 11. A guide member 13 for guiding the transfer paper P is also disposed below the transfer drum 11. Also provided on a predetermined position of the transfer drum 11 is a clipper (not shown) for assisting the transfer roller 39 in winding the transfer paper P around the surface of the transfer drum 11.

Figure 21:
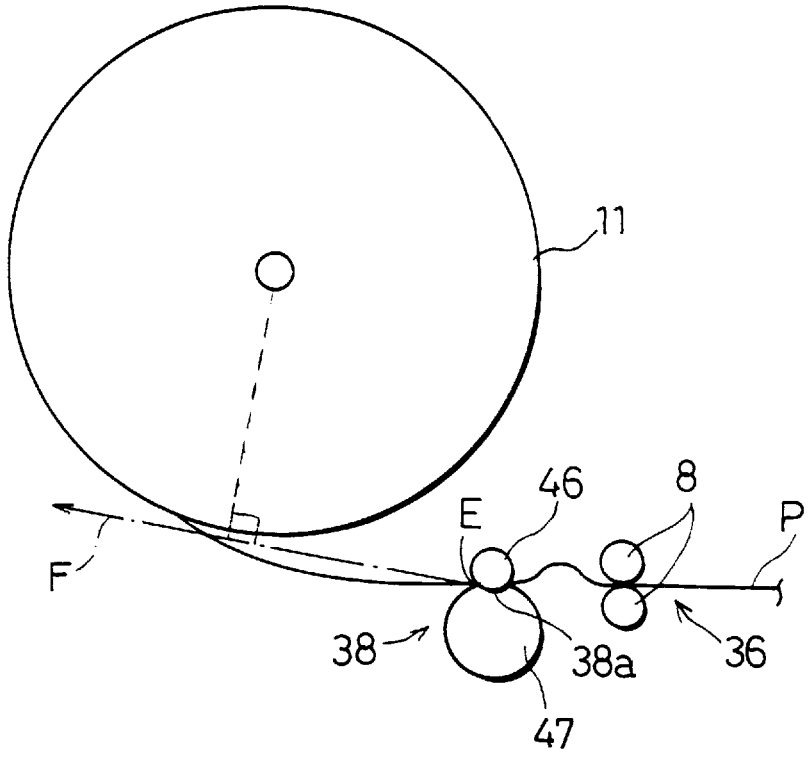
FIG. 21 is a front view schematically showing the structure near a transfer drum according to still another embodiment of the present invention.

As illustrated in FIG. 21, the pair of register rollers 38 include a hard roller (a second roller) 46 and a soft roller (a first roller) 47. The hard roller 47 curls the transfer paper P in an arc similar to the shape of an outer surface of the transfer drum 11 so as to facilitate the winding of the transfer paper P around the surface of the transfer drum 11. Namely, the pair of register rollers 38 perform both the function of the register roller and the function of the curl roller. The hard roller 46 is located closer to the transfer drum 11 than the soft roller to the transfer drum 11. The hard roller 46 is a driving roller which is rotated by a driving force of driving means, for example, a motor (not shown). The soft roller 47 is a driven roller which is rotated by the rotation of the hard roller 46. The installation structure of the soft roller 47 will be described later.

The ratio of the diameter of the hard roller 46 to that of the soft roller 47 (hereinafter referred to as the hard roller-to-soft roller diameter ratio) is set within a range between 0.2 and 1.0. A detailed explanation of the diameter ratio will be given later.

For example, the hard roller 46 is formed by metal such as aluminum and stainless, synthetic resins such as a fluorocarbon resin, metal covered with a synthetic resin or rubber, or synthetic resins covered with rubber, and has a hardness which is larger than that of the soft roller 47. Since the hard roller 46 is formed by such a material, there is no possibility that the hard roller 46 is warped by the pressing force, to be described later, and the frictional resistance to the transfer paper P is increased. Consequently, the pair of the register rollers 38 perform stable transporting operations. It is thus possible to prevent so-called oblique feeding in which the transfer paper P is moved in an oblique direction to the rotation axis of the hard roller 46 or the soft roller 47.

For example, the soft roller 47 is formed by synthetic foam resins such as a urethane foam resin and a silicon foam resin, or rubber such as urethane rubber, silicon rubber, chloroprene rubber (CR) and acrylonitrile-butadiene rubber (NBR). The hardness of the soft roller 47 is set in a range between 10 and 50 degrees in ASKER C. A detailed explanation of the hardness will be given later.

The distance between the axis of the hard roller 46 and that of the soft roller 47 is set to be smaller than a length obtained by the sum of a radius of the hard roller 46 and a radius of the soft roller 47. Therefore, the hard roller 46 and the soft roller 47 are brought into contact with each other by pressure so that the hard roller 46 cuts into the soft roller 47 at the contact position. Hence, as illustrated in FIG. 21, when the transfer paper P passes through the contact position (hereinafter referred to as the nip section) 38*a* of the hard roller 46 and the soft roller 47, which is curved in an arc, the transfer paper P is curled along the outer surface of the transfer drum 11.

The transfer paper P is transported to come into contact with the hard roller 46 by the transfer-paper transport path 36, PF rollers 8, etc. The front edge of the transfer paper P is aligned substantially parallel to the rotating shaft of the hard roller 46 on the surface of the hard roller 46. Then, the transfer paper P passes through the nip section 38*a*. The pair of register rollers 38 function as register rollers. Consequently, the front edge of the transfer paper P stops on the surface of the hard roller 46, and the transfer paper P is once curved between the hard roller 46 and the PF rollers 8 on the transfer-paper transport path 36. Thereafter, the transfer paper P is timely supplied to the transfer drum 11. The degree of curve of the transfer paper P is detected by a sensor, not shown. The hard roller 46 is driven to rotate when the degree of curve of the transfer paper P detected by the sensor becomes equal to a predetermined degree.

The transfer drum 11 is positioned so that a tangent line F on the surface of the hard roller 46 at an end E of the nip section 38*a* which is closer to the transfer drum 11 (i.e., the transfer-paper carrying body) does not touch the surface of the transfer drum 11. Namely, the transfer drum 11 and the hard roller 46 are positioned on the same side of the tangent line F. With this arrangement, since the approach angle of the transfer paper P to the transfer drum 11 is decreased, the transfer paper P is easily wound around the surface of the transfer drum 11. As described above, the transfer paper P is wound around and held on the surface of the transfer drum 11 by electrostatic adhesion. The approach angle is an angle between a plane tangent to the transfer drum 11 and a plane tangent to a front edge of the transfer paper P at a position where the front edge of the transfer paper P comes into contact with the surface of the transfer drum 11.

Figure 23A:
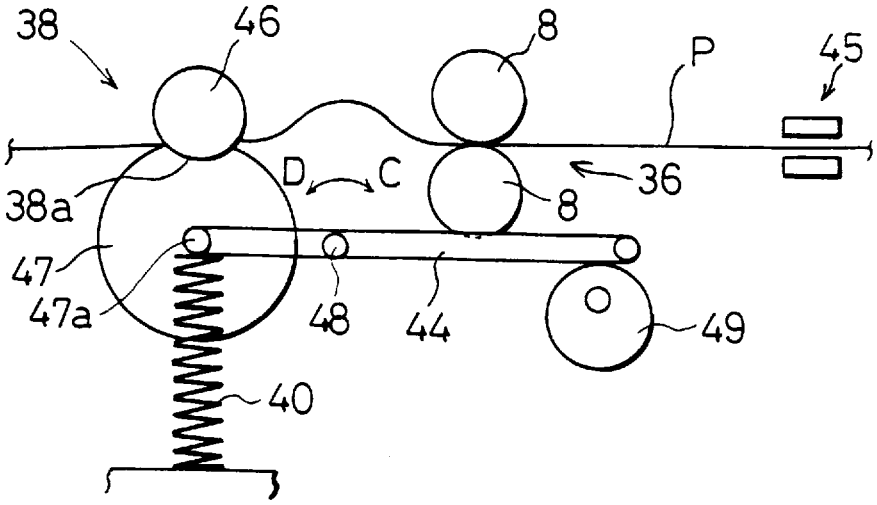
FIGS. 23(*a*) and 23(*b*) are explanatory views showing the installation structure of a soft roller in the copying machine shown in FIG. 22.
Figure 23B:
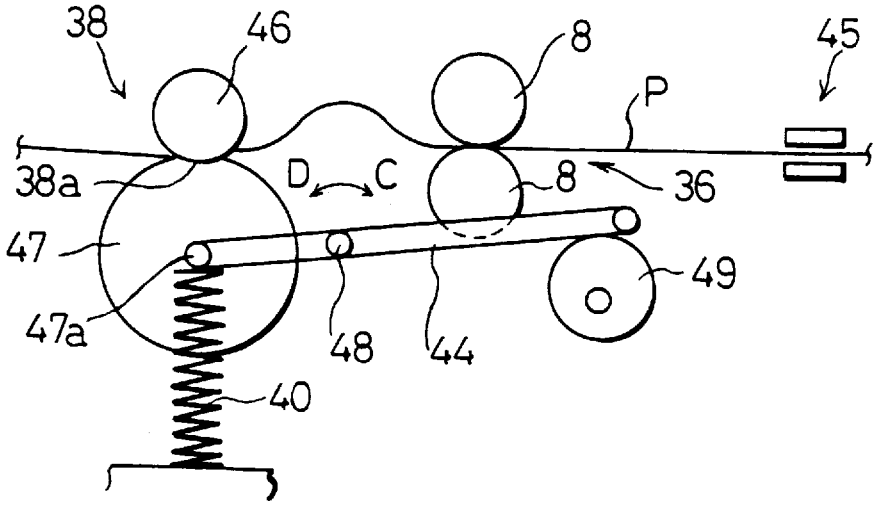

The following description discusses the installation structure of the soft roller 47. As illustrated in FIGS. 23(*a*) and 23(*b*), a spring 40 and a rotating shaft 44 are mounted on a shaft 47*a* of the soft roller 47. One of the ends of the spring is attached to the shaft 47*a*, while the other end is fixed to a predetermined position of the main body of the copying machine. The rotating shaft 44 is pivotable in the C–D directions shown by arrows in FIGS. 23(*a*) and 23(*b*) on a supporting point 48. One of the ends of the rotating shaft 44 is attached to the shaft 47*a*, while the other end is supported by a cam 49.

A sensor 45 is disposed in a predetermined position which is a further upstream position of the transfer-paper transport path 36 than the position where the PF rollers 8 are located. The sensor 45 irradiates the transfer paper P with light, and measures the transmissivity of the light. The sensor 45 converts the measured transmissivity into an electric signal and outputs the electric signal to a control device (not shown). The control device judges the type, paper quality, thickness and size of the transfer paper P from the electric signal.

It is also possible to provide various detection sensors for detecting the size of the feed cassette 5, the size of a toner image formed on the photoreceptor drum 15, etc., instead of the sensor 45. In this case, the type, paper quality, thickness and size of the transfer paper P are determined based on the detected results of the detection sensors.

Figure 24A:
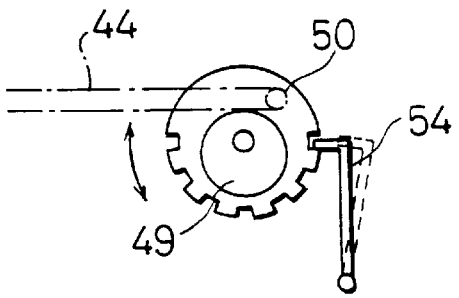
FIGS. 24(*a*) and 24(*b*) are explanatory views showing an operation of pressure changing means in the copying machine shown in FIG. 22.
Figure 24B:
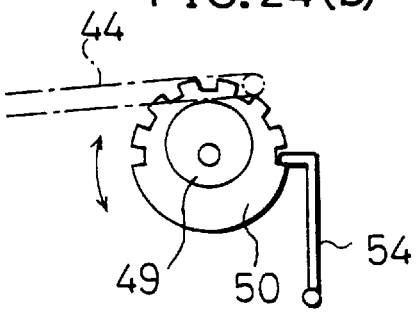

As illustrated in FIGS. 24(*a*) and 24(*b*), a gear 50 is attached to the cam 49, and a flapper 54 is rotatably mounted in the vicinity of the gear 50 so that the gear 50 is locked when the flapper 54 and the gear 50 mesh. The pressure changing means is formed by the spring 40, rotating shaft 44, cam 49, gear 50 and flapper 54.

The cam 49 is rotated by a solenoid (not shown), etc. according to the type, paper quality, thickness and size of the transfer paper P. The operations of the flapper 54 and solenoid are controlled by a control device (not shown). Thus, the soft roller 47 is brought into contact with the hard roller 46 by a pressure of the spring 40. The pressure is adjustable by an amount of rotation of the cam 49 through the rotating shaft 44.

For instance, when the transfer paper P is a so-called copy paper or ordinary paper, or when the paper quality is hard and thick, as illustrated in FIG. 24(*a*), the flapper 54 is moved to a position shown by the dot lines so that the flapper 54 and the gear 50 are disengaged. Then, the cam 49 is rotated so that the minimum eccentric section of the cam 49 comes into contact with the rotating shaft 44. With the rotation of the cam 49, as illustrated in FIG. 23(*a*), the rotating shaft 44 is rotated in the direction of arrow C. Thereafter, as illustrated in FIG. 24(*a*), the flapper 54 is moved to a position indicated by the solid lines so that the flapper 54 and the gear 50 are engaged and locked. As a result, the soft roller 47 is firmly pressed against the hard roller 46. The maximum pressure is produced in the state shown in FIG. 24(*a*). In this state, since the length of the nip 38*a* formed between the hard roller 46 and the soft roller 47 in the transfer-paper transport direction is increased, the degree of curl of the transfer paper P becomes larger.

For example, when the transfer paper P is an envelope or a label, or when the paper quality is soft and thin, the cam 49 is rotated so that the maximum eccentric section of the cam 49 comes into contact with the rotating shaft 44 after disengaging the flapper 54 and the gear 5O. With the rotation of the cam 49, as illustrated in FIG. 23(*b*), the rotating shaft 44 is rotated in the direction of arrow D. Thereafter, as illustrated in FIG. 24(*b*), the flapper 54 and the gear 50 are engaged and locked. As a result, the soft roller 47 is softly pressed against the hard roller 46. The minimum pressure force is produced in the state shown in FIG. 24(*b*). In this state, since the length of the nip 38*a* in the transfer-paper transport direction is decreased, the degree of curl of the transfer paper P becomes smaller.

As described above, the pressure of the soft roller 47 to the hard roller 46 is freely changed by rotating the cam 49. Namely, the pair of register rollers 38 freely change the degree of curl according to the type, paper quality, thickness and size of the transfer paper P. Moreover, since the soft roller 47 is formed by the above-mentioned material, the pressure of the pressure changing means is uniformly applied to any positions of the rotating shaft of the soft roller 47. With this structure, since the pair of register rollers 38 perform stable transporting operations, it is possible to prevent the oblique feeding of the transfer paper P and to evenly curl the entire transfer paper P.

Figure 25:
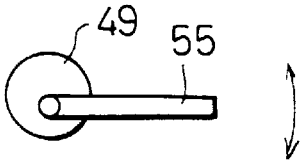
FIG. 25 is an explanatory view showing a modified example of the pressure changing means.

It is also possible to mount a lever 55 on the cam 49 and lock the cam 49 by manually moving the lever 55 as shown in FIG. 25, instead of locking the cam 49 by the flapper 54 and the gear 50.

The value of the above-mentioned diameter ratio needs to be set so that (1) the nip section 38*a* formed between the hard roller 46 and the soft roller 47 becomes larger and that (2) the transfer paper P is evenly pressed by a predetermined pressure at the nip section 38*a* according to the type, paper quality, thickness and size of the transfer paper P. By setting the diameter ratio to a suitable value, the winding of the transfer paper P around the surface of the transfer drum 11 is satisfactorily and stably carried out without regard to the type, paper quality, thickness and size of the transfer paper P. The winding of the transfer paper P around the surface of the transfer drum 11 was studied by changing the diameter ratio. The results are shown in Table 12.

TABLE 12

| TRANSFER | DIAMETER RATIO | | | | | |
|---|---|---|---|---|---|---|
| QUALITY | 0.1 | 0.2 | 0.5 | 1.0 | 1.2 | 1.5 |
| 50 g paper | ○ | ○ | ○ | ○ | ○ | x |
| 75 g paper | ○ | ○ | ○ | ○ | x | x |
| 128 g paper | Δ | ○ | ○ | ○ | x | x |

○: transfer paper is properly wound on transfer drum 11
x: transfer paper is not properly wound on transfer drum 11
Δ: transfer paper is not properly separated from transfer drum 11

As shown in Table 12, the transfer paper P is satisfactorily and stably wound around the surface of the transfer drum 11 without regard to the type, paper quality, thickness and size of the transfer paper P by setting the diameter ratio within a range between 0.2 and 1.0.

The hardness of the soft roller 47 needs to be set so that (1) a large nip section 38*a* is obtained when the diameter of the hard roller 46 and the pressure of the pressure changing means are set uniform and that (2) the transfer paper P is evenly pressed by a predetermined pressure at the nip section 38*a* according to the type, paper quality, thickness and size of the transfer paper P. By setting the hardness to a suitable value, the winding of the transfer paper P around the surface of the transfer drum 11 is satisfactorily and stably carried out without regard to the type, paper quality, thickness and size of the transfer paper P. The winding of the transfer paper P around the surface of the transfer drum 11 was studied by changing the hardness. The results are shown in Table 13.

TABLE 13

| TRANSFER PAPER | HARDNESS (ASKER C) | | | | |
|---|---|---|---|---|---|
| QUALITY | 5 | 10 | 25 | 50 | 75 |
| 50 g paper | ○ | ○ | ○ | ○ | ○ |
| 75 g paper | x | ○ | ○ | ○ | ○ |
| 128 g paper | x | ○ | ○ | ○ | x |

○: transfer paper is properly wound on transfer drum 11
x: transfer paper is not properly wound on transfer drum 11

As shown in Table 13, the winding of the transfer paper P around the surface of the transfer dram 11 is satisfactorily and stably carried out without regard to the type, paper quality, thickness and size of the transfer paper P by setting the hardness within a range between 10 and 50 degrees in ASKER C.

As described above, by setting the diameter ratio in a range between 0.2 and 1.0, the hardness of the soft roller 47 in a range between 10 and 50 degrees in ASKER C, the transfer paper P is satisfactorily and stably wound around the surface of the transfer drum 11 irrespectively of the type, paper quality and thickness of the transfer paper P.

With the above-mentioned configuration, a color copy (3-color copy) is produced as follows. First, when the surface of the photoreceptor drum 15 is evenly charged by the charger 20, the scanner unit (not shown)of the unit section 34 performs a first scanning operation. As a result, the image data read by the CCD sensor is output as laser light corresponding to yellow data by the laser driver unit (not shown) of the unit section 34. When the surface of the photoreceptor drum 15 is exposed to the laser light, an electrostatic latent image corresponding to the yellow data is formed on the exposed area. Then, toner is supplied to the electrostatic latent image from a yellow developer container 16 so as to form a yellow toner image.

At the substantially same time as the above-mentioned electrostatic image forming operation, the surface of the transfer drum 11 is evenly charged by a charger (not shown) and the transfer paper P is supplied to the transfer drum 11 from the feed cassette 5 or the manual-feed section 37 through the pair of register rollers 38. More specifically, when supplying the transfer paper P from the feed cassette 5, the transfer paper P is fed sheet by sheet to the transfer-paper transport path 36 by the pickup roller 7 and then transported to the pair of register rollers 38 by the PF rollers 8. On the other hand, when supplying the transfer paper P from the manual-feed section 37, the transfer paper P is transported to the pair of register rollers 38 by the PF rollers 8.

The transfer paper P transported to the pair of register rollers 38 passes through the nip section 38*a* formed between the hard roller 46 and the soft roller 47. At this time, the transfer paper P is curled in an arc by a predetermined degree at the nip section 38*a* so that the transfer paper P is curved in a direction toward the transfer drum 11. Thereafter, the transfer paper P is timely supplied to the transfer drum 11. Then, the transfer paper P is pressed against the transfer drum 11 by the transfer roller 39, and is wound around and held on the transfer drum 11 by electrostatic adhesion because of charges induced on the surface of the transfer drum 11.

Next, the yellow toner image is transferred to the transfer paper P pressed against the photoreceptor drum 15 by a potential difference between the charge of the yellow toner image and the charge on the surface of the transfer paper P. At this time, some toner which is not used in the transfer process remains. The remaining toner is then scraped by the cleaning blade 21. Additionally, the charge removing lamp (not shown) removes any residual charges on the surface of the photoreceptor drum 15.

When the above-mentioned processes are complete, the surface of the photoreceptor drum 15 is evenly charged again by the charger 20, and the scanner unit performs a second scanning operation. The image data obtained by the scanning operation is output as laser light corresponding to magenta data by the laser driver unit. When the surface of the photoreceptor drum 15 is exposed to the laser light, an electrostatic latent image corresponding to the magenta data is formed on the exposed area. Then, toner is supplied to the electrostatic latent image from a magenta developer container 17 so as to form a magenta toner image. Subsequently, the toner image is transferred so that the magenta image is superimposed on the yellow image.

After the cleaning blade 21 and the charge removing lamp perform the above-mentioned operations, the surface of the photoreceptor drum 15 is evenly charged by the charger 20, and the scanner unit performs a third scanning operation. With the scanning operation, the photoreceptor drum 15 is exposed to laser light corresponding to cyan data, and an electrostatic latent image corresponding to the cyan data is formed. Subsequently, toner is supplied from a cyan developer container 18 to the photoreceptor drum 15 so as to form a cyan toner image. Finally, the toner image is transferred so that the cyan image is superimposed on the magenta image and yellow image.

After transferring the toner to the transfer paper P, the transfer paper P is separated from the transfer drum 11 by a separating claw 71, the toner image is fused onto the transfer paper P by the fixing device 4, and the transfer paper P is discharged from the copying machine by the discharge roller 24.

The above-mentioned processes are designed for producing a three-color copy. When producing a four-color copy, a process using black toner contained in a black developer container 19 is added to the above-mentioned processes. Whereas when producing a black-and-white copy, black toner is supplied from the black developer container 19 to an electrostatic latent image on the surface of the photoreceptor drum 15 and the toner image is transferred to the transfer paper P.

As described above, in the copying machine as the image forming apparatus having the above-mentioned structure, the pair of register rollers 38 for timely supplying the transfer paper P to the transfer drum 11 are formed by the soft roller 47 of a predetermined hardness and the hard roller 46 of a hardness larger than the hardness of the soft roller 47, and the hard roller 46 and the soft roller 47 are brought into contact with each other by pressure. Therefore, when the transfer paper P passes through the nip section 38*a* formed between the hard roller 46 and the soft roller 47, it is curled in an arc along the outer surface of the transfer drum 11. The transfer drum 11 and the hard roller 46 are positioned on the same side of the tangent line F on the surface of the hard roller 46 at the end E of the nip section 38*a* nearer to the transfer drum 11. This arrangement decreases the approach angle of the transfer paper P to the transfer drum 11.

If the transfer drum 11 crosses the tangent line F, the curled front edge of the transfer paper P comes into contact with the surface of the transfer drum 11, preventing the transfer paper P from being wound around the outer surface of the transfer drum 11. Moreover, if the transfer drum 11 is located too far from the pair of register rollers 38, the transfer paper P is rolled up before it reaches the transfer drum 11. It is therefore desirable to arrange the front edge of the transfer paper P to come into contact with the surface of the transfer drum 11 through a small approach angle after it passes a perpendicular line from the axis of the transfer drum 11 to the tangent line F.

This arrangement prevents the transfer paper P from being caught on the transfer drum 11 and from jumping on the transfer drum 11. Consequently, the transfer paper P is easily wound around the surface of the transfer drum 11. In addition, since the transfer paper P is curled by the pair of register rollers 38, it is possible to make the length of the transfer-paper transport path 36 shorter than that of a conventional copying machine in which a pair of register rollers and a pair of curl rollers are separately provided. This configuration decreases the possibility of a so-called paper jam. Moreover, since the transfer paper P can never be supplied to the transfer drum 11 at a wrong time, the toner image is transferred to a desired location on the transfer paper P. Furthermore, since the number of component parts is reduced, it is possible to decrease the size, structure and cost of the copying machine.

Since the pressure for bringing the hard roller 46 and the soft roller 47 into contact with each other is freely changeable by the pressure changing means such as the spring 40, rotating shaft 44, cam 49, gear 50 and flapper 54, the pressure is changed according to, for example, the type, paper quality, and thickness of the transfer paper P. As a result, even when paper of different type, paper quality and thickness is used as the transfer paper P, the transfer paper with a uniform degree of curl is stably supplied to the transfer drum 11.

The transfer paper P is transported to come into contact with the hard roller 46 by the transfer-paper transport path 36, PF rollers 8, etc. Therefore, the front edge of the transfer paper P is aligned substantially parallel to the axis of the hard roller 46 on the surface of the hard roller 46, and then transported to the nip section 38*a*. This structure prevents such a supply problem that the transfer paper P is supplied to the transfer drum 11 from an oblique direction. This structure also prevents a displacement of the transfer paper P from being caused by, for example, a slight warp of the soft roller 47 or the transfer paper P caught on the soft roller 47.

In the copying machine having the above-mentioned structure, since the hardness of the soft roller 47 is in a range between 10 and 50 degrees in ASKER C, the length of the nip section 38*a* in the transfer-paper transporting direction is increased. Moreover, since the diameter ratio of the hard roller 46 to the soft roller 47 is in a range between 0.2 and 1.0, it is possible to increase the length of the nip section 38*a* in the transfer-paper transporting direction. With this arrangement, since the transfer paper P is satisfactorily curled by the pair of register rollers 38, the transfer paper P is more easily wound around the surface of the transfer drum 11.

In this copying machine, the hard roller 46 is rotated by a driving force of a motor (not shown). Namely, the hard roller 46 is a driving roller and the soft roller 47 is a driven roller. Therefore, in comparison with a structure in which the soft roller 47 is rotated or the hard roller 46 and the soft roller 47 are rotated, the pair of register rollers 38 are rotated in a more stable manner even if, for example, the soft roller 47 is slightly warped. With this structure, since the transporting speed of the transfer paper P is kept uniform, the transfer paper P is supplied to the transfer drum 11 by uniform timing.

Additionally, since the transfer-paper transport path 36 has the sheet transport path 36*a* and the manual-feed transport path 36*b* that join together, it is possible to curl the transfer paper P transported by the sheet transport path 36*a* and the transfer paper P transported to the manual-feed transport path 36*b* along the outer surface of the transfer drum 11 by the same pair of register rollers 38. With this arrangement, since an increase in the number of component parts is prevented, it is possible to achieve a compact copying machine with a simplified structure and reduce the cost.

This embodiment was explained by taking a copying machine as an example of the image forming apparatus. However, the image forming apparatus is not limited to the copying machine, and it may be a digital printer, a facsimile machine, a scanner printer, etc.

[Embodiment 10]

Figure 26:
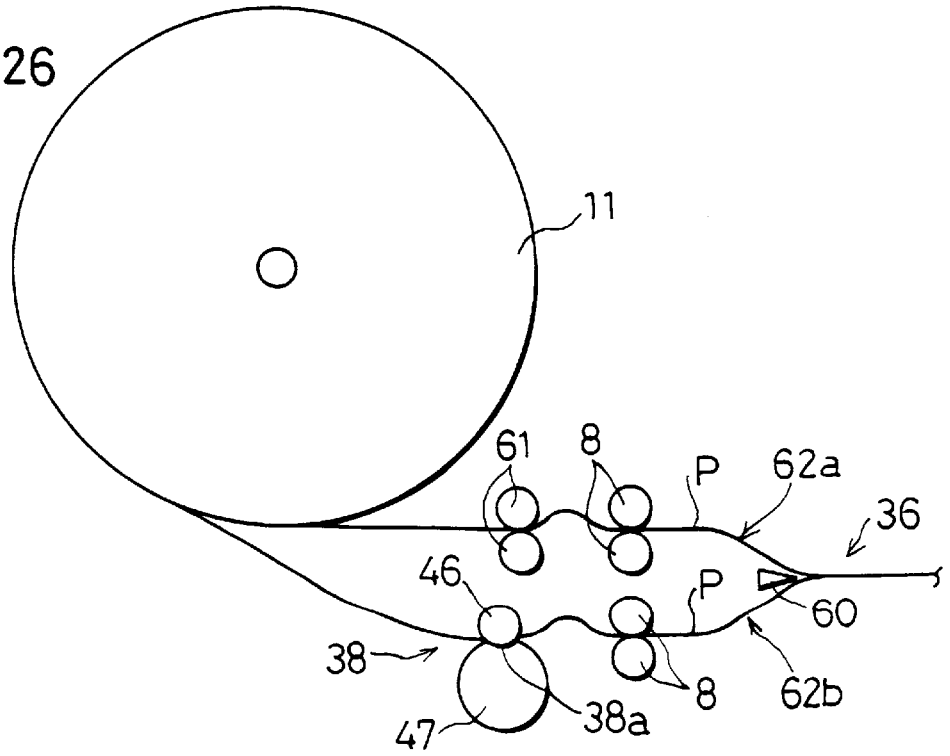
FIG. 26 is a front view schematically showing the structure near a transfer drum according to still another embodiment of the present invention.

The following description discusses another embodiment of the present invention with reference to FIG. 26. The members having the same function as in the above-mentioned embodiments will be designated by the same code and their description will be omitted.

As illustrated in FIG. 26, a copying machine as an image forming apparatus of this embodiment has a first transport path 62*a* and a second transport path 62*b* in further downstream sections than the joint of the sheet transport path 36*a* and the manual-feed transport path 36*b* in the transfer-paper transport path 36 (see FIG. 22). The first transport path 62*a* includes register rollers 61 and the PF rollers 8. The second transport path 62*b* includes the pair of register rollers 38 and the PF rollers 8. The register rollers 61 have a substantially uniform hardness, and supply the transfer paper P to the transfer drum 11 at a predetermined time.

A switching member (switching means) 60 is disposed at the junction of the first transport path 62*a* and the second transport path 62*b*. The switching member 60 selectively connects the transport path of the transfer paper to the first transport path 62*a* or the second transport path 62*b* according to, for example, the type, paper quality and thickness of the transfer paper P. The switching member 60 is driven by a driving mechanism controlled by a control device (both of them are not shown). The switching member 60 may be switched by operating keys on a control panel (not shown).

The transporting means is thus formed by the transfer-paper transport path 36 including the sheet transport path 36*a*, the manual-feed transport path 36*b*, the first transport path 62*a* and the second transport path 62*b*, the pair of register rollers 38, the register rollers 61, the switching member 60, and the PF rollers 8. Except for this, the structure of this copying machine is the same as that of the copying machine of Embodiment 9. Specifically, the copying machine of this embodiment is the copying machine of Embodiment 9, and further includes the first transport path 62*a* having the register rollers 61 and the PF rollers 8, and the switching member 60.

As described above, the copying machine as an image forming apparatus having the above-mentioned structure includes the second transport path 62*b* having the pair of register rollers 38, the first transport path 62*a* having the register rollers 61 of a substantially uniform hardness for timely supplying the transfer paper P to the transfer drum 11, and the switching member 60 for switching the transport path of the transfer paper P.

With this structure, the switching member 60 selectively switches the transport path to the first transport path 62*a* or the second transport path 62*b* according to the type, paper quality and thickness of the transfer paper P. For instance, when the transfer paper P is so-called copy paper or ordinary paper, or when the paper quality is hard and thick, the transporting direction of transfer paper P is switched to the second transport path 62*b* by the switching member 60. As a result, the transfer paper P passes through the nip section 38*a* between the hard roller 46 and the soft roller 47, and is curled in an arc along the outer surface of the transfer drum 11.

On the other hand, for example, if the transfer paper P is an envelope or a label which tends to get creased when curled, or if the transfer paper P is a type of a sheet which is soft and thin and tends to roll up and cause paper jam when curled, the transporting direction is switched to the first transport path 62*a* by the switching member 60. It is therefore possible to supply to the transfer drum 11 the transfer paper P without being curled.

Hence, even if transfer paper P of different type, paper quality and thickness is used, the possibility of paper jam is decreased and the transfer paper P is stably supplied in a satisfactory state to the transfer drum 11.

Furthermore, since the first transport path 62*a* supplies the transfer paper P to the transfer drum 11 without curling the transfer paper P, it is desirable to dispose the register rollers 61 closer to the transfer drum 11 than the pair of register rollers 38 to the transfer drum 11. With this configuration, the transfer paper P adheres to the transfer drum 11 before the flat edge of the transfer paper P falls down due to its own weight.

[Embodiment 11]

The following description discusses another embodiment of the present invention with reference to FIGS. 22, 27 to 31. The members having the same function as in the above-mentioned embodiments will be designated by the same code and their description will be omitted.

As illustrated in FIG. 22, a separating claw 71 is mounted in the vicinity of the outer surface of the transfer drum 11, more specifically, between a transfer position where the photoreceptor drum 15 and the transfer drum 11 are in contact with each other and the fixing unit 4 located above the transfer position. A solenoid (switching means) 72 is disposed on a side wall surface of the main body 33 of the copying machine. The separating claw 71 has a pointed end, and is connected to the solenoid 72 by a supporting shaft 73 and a driving arm 74. The separating claw 71 is pivoted on the supporting shaft 73 by switching the solenoid 72 between on and off. Therefore, the position of the pointed end of the separating claw 71 is changed between a distant position which is separated from the outer surface of the transfer drum 11 by a predetermined distance and a contact position where the pointed end comes into contact with the outer surface of the transfer drum 11.

As described above, when producing a color image by rotating the transfer drum 11 four times, the separating claw 71 is kept in the distant position until the last toner image is transferred. When the transfer paper P to which the last toner image has been transferred is transported from the transfer position, the separating claw 71 is switched to the contact position from the distant position at a predetermined time, to be described later.

As a result, the transfer paper P is lifted up by the pointed end of the separating claw 71, forced to separate from the outer surface of the transfer drum 11, and guided to the fixing unit 4 along an upper sloping surface of the separating claw 71.

As described above, the transfer paper P which has been separated from the transfer drum 11 by the separating claw 71 and transported to the fixing unit 4 is moved upward through a fixing section which is the contact position between a heat roller 76 and a press roller 77 by the fixing guide 75. At this time, the toner on the transfer paper P is melted by the heat of the fixing. section and fixed to the transfer paper P by the pressure thereof. The transfer paper P fed from the fixing unit 4 is guided to a left direction by the discharge guide 78 located above the fixing unit 4, and output onto a top cover 79 which covers the unit section 34 by the discharge roller 24.

The following description explains in detail a positional relation among the transfer drum 11, the photoreceptor drum 15, and the separating claw 71 in the apparatus.

Figure 27:
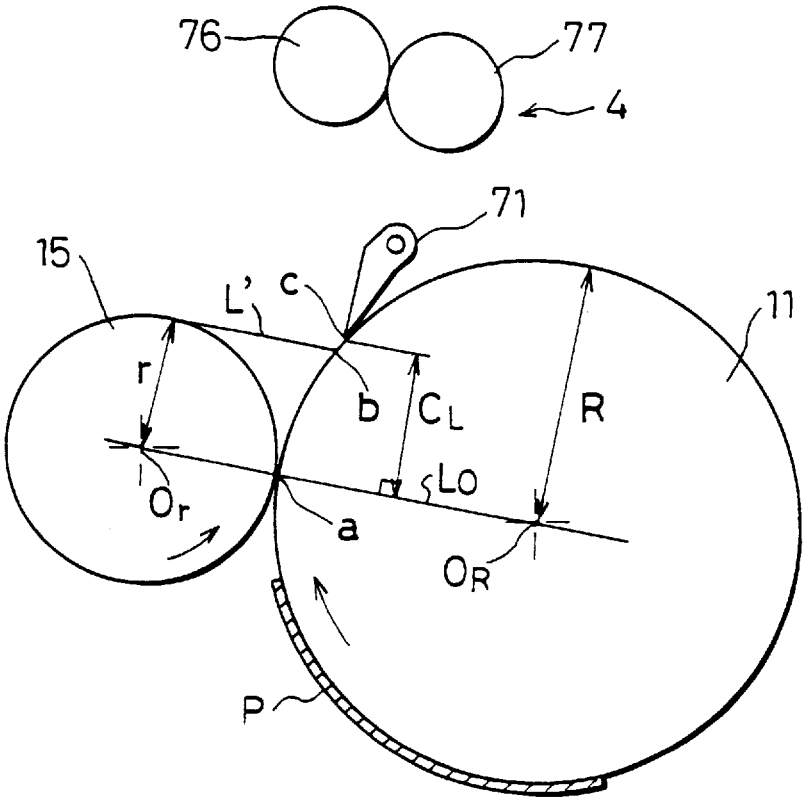
FIG. 27 is a depiction of a cross section showing a positioning relation between the transfer drum and a separating claw according to another embodiment of the present invention.

As illustrated in FIG. 27, a radius of the photoreceptor drum 15 is represented by r, and a radius of the transfer drum 11 is indicated by R. Specifically, for example, the photoreceptor drum 15 has a radius r of 35 mm, and the transfer drum 11 has a radius R of 70 mm. Denoting the center point of the photoreceptor drum 15 as $O_r$, the center point of the transfer drum 11 as $O_R$ and a straight line connecting the center points $O_r$ and $O_R$ by the shortest distance as $L_o$, the intersection between line $L_o$ and the outer surface of the transfer drum 11 (or the outer surface of the photoreceptor drum 15) becomes a contact point a of the transfer drum 11 and the photoreceptor drum 15.

The separating claw 71 is disposed so that, when the separating claw 71 is in the contact position, the pointed end thereof comes into contact with the outer surface of the transfer drum 11 at a section of the transport path between the contact point a and the fixing unit 4. More specifically, the contact point (hereinafter referred to as separation point) c is set so that a distance $C_L$ between the separation point c and the straight line $L_o$ becomes larger than the radius r of the photoreceptor drum 15, i.e., $C_L$>r.

Figure 28:
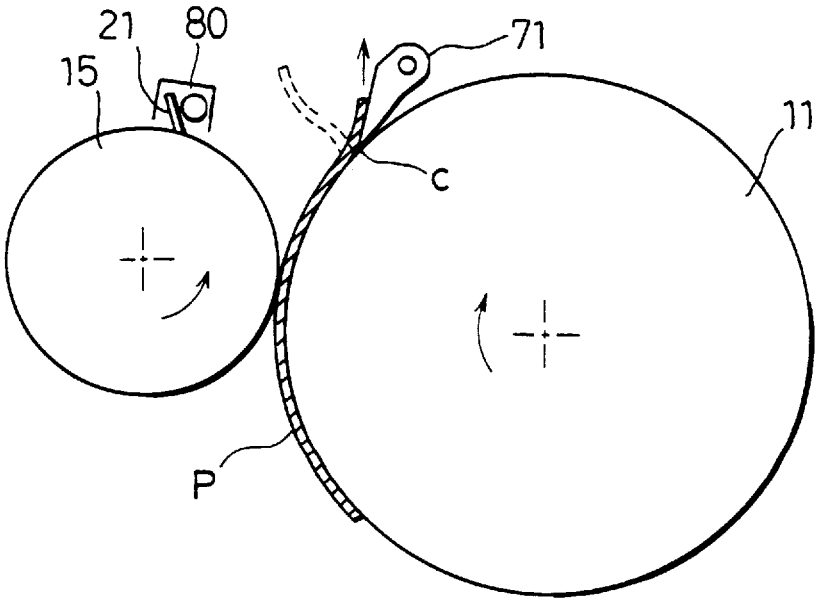
FIG. 28 is a depiction of a cross section explaining how recording paper is separated from the transfer drum shown in FIG. 27.

In FIG. 27, b is a point on the outer surface of the transfer drum 11 where the distance between the separation point c and the straight line $L_o$ is-equal to the radius r of the photoreceptor drum 15, and L' is a straight line which extends from the point b to the outer surface of the photoreceptor drum 15 in parallel with the straight line $L_o$. The separation point c is located above the straight line L'. Therefore, as illustrated in FIG. 28, even when the transfer paper P which has been separated from the transfer drum 11 at the separation point c is fed toward the fixing unit 4 while being warped like being bent in a direction toward the photoreceptor drum 15 or undulated, it does not come into contact with the surface of the photoreceptor drum 15 after the separating process unless the degree of bend exceeds 90°.

The relationship between the separation position c and disorderly images was studied by carrying out some tests. The results are shown in Tables 14 and 15.

TABLE 14

RESULTS OF TESTING DISORDERLY IMAGES (NO. 1 - UNDER DIFFERENT ENVIRONMENTAL CONDITIONS)

| ENVIRONMENTAL CONDITIONS | TYPES OF DEFECTS | SET POSITION OF SEPARATION POINT c | | |
|---|---|---|---|---|
| | | $C_L < R$ | $C_L = R$ | $C_L > R$ |
| NORMAL TEMPERATURE AND NORMAL HUMIDITY | PAPER JAM | 0/100 | 0/100 | 0/100 |
| | DISORDERLY IMAGE | 2/100 | 0/100 | 0/100 |
| LOW TEMPERATURE AND LOW HUMIDITY | PAPER JAM | 1/100 | 0/100 | 0/100 |
| | DISORDERLY IMAGE | 1/100 | 0/100 | 0/100 |
| HIGH TEMPERATURE AND HIGH HUMIDITY | PAPER JAM | 1/100 | 0/100 | 0/100 |
| | DISORDERLY IMAGE | 1/100 | 0/100 | 0/100 |

*Number of copies containing disorderly images/number of copies produced
Image ratio: 4%

TABLE 15

RESULT OF TESTING DISORDERLY IMAGES (NO. 2 - WITH DIFFERENT IMAGE RATIO)

| IMAGE RATIO | TYPES OF DEFECTS | SET POSITION OF SEPARATING POINT c | | |
|---|---|---|---|---|
| | | $C_L < R$ | $C_L = R$ | $C_L > R$ |
| BLACK SOLIDS | PAPER JAM | 0/100 | 0/100 | 0/100 |
| | DISORDERLY IMAGES | 1/100 | 0/100 | 0/100 |

TABLE 15-continued

RESULT OF TESTING DISORDERLY IMAGES (NO. 2 - WITH DIFFERENT IMAGE RATIO)

| IMAGE RATIO | TYPES OF DEFECTS | SET POSITION OF SEPARATING POINT c | | |
|---|---|---|---|---|
| | | $C_L < R$ | $C_L = R$ | $C_L > R$ |
| IMAGE RATIO OF 4% | PAPER JAM | 1/100 | 0/100 | 0/100 |
| | DISORDERLY IMAGES | 1/100 | 0/100 | 0/100 |
| WHITE SOLIDS | PAPER JAM | 1/100 | 0/100 | 0/100 |
| | DISORDERLY IMAGES | 1/100 | 0/100 | 0/100 |

*Number of copies containing disorderly images/number of copies produced

As shown in Tables 14 and 15, disorderly images were produced irrespective of environmental conditions and the image ratio when a distance $C_L$ between the line $L_o$ connecting the center of the photoreceptor drum 15 and that of the transfer drum 11 and the separation point c was set smaller than the radius r of the photoreceptor drum 15. The disorderly images may be caused due to the following reason. Since the separation point c is located near the contact point a, if the transfer paper P separated at the separation point c warps or becomes wavy, it tends to come into contact with a cleaning unit 80 having the cleaning blade 21 and the toner image on the transfer paper P is rubbed.

On the other hand, when the separation point c is set so that $C_L \geqq r$, as described above, even if the transfer paper P separated at the separation point c warps or becomes wavy, it is transported without making contact with the photoreceptor drum 15 because the photoreceptor drum 15 is not disposed in a transporting direction of the transfer paper P. It is therefore possible to have satisfactory image quality and transporting performance without causing disorderly images and paper jam.

Next, the following description discusses the control of the switching of the position of the separating claw 71 between the distant position and the contact position.

Figure 29:
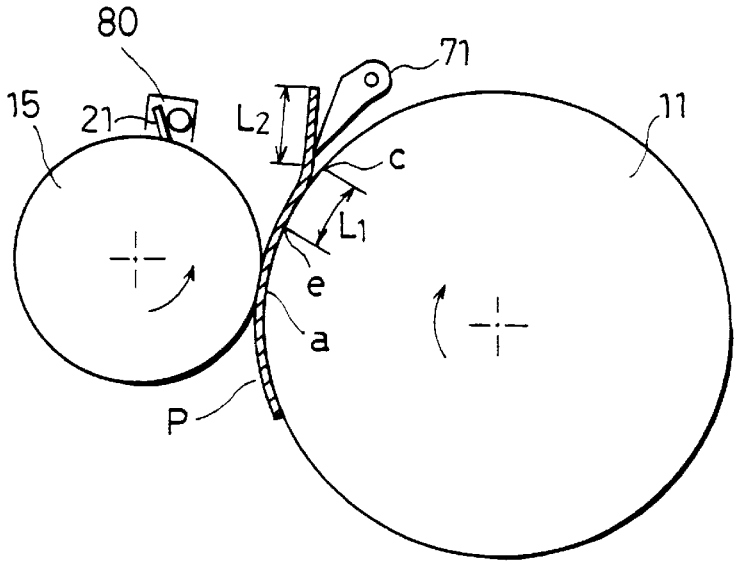
FIG. 29 is a depiction of a cross section explaining the timing for switching the position of the separating claw for separating the recording paper from the transfer drum shown in FIG. 27.
Figure 30:
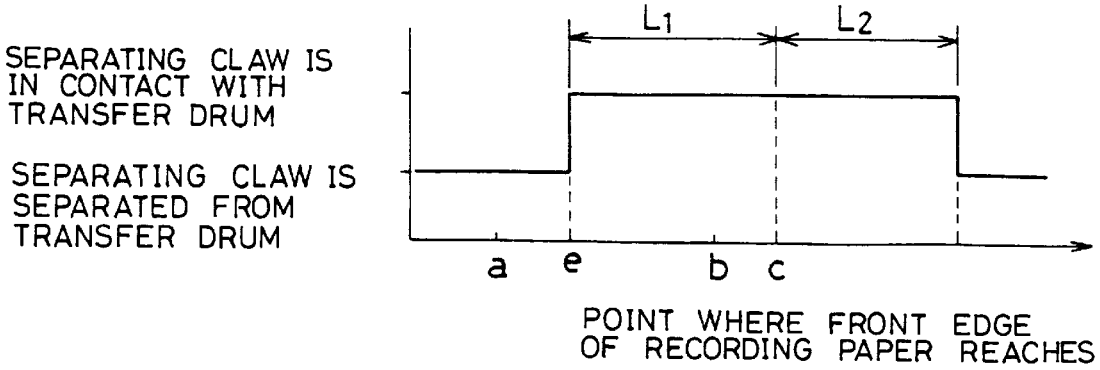
FIG. 30 is a timing chart explaining the switching of the position of the separating claw shown in FIG. 29.
Figure 31:
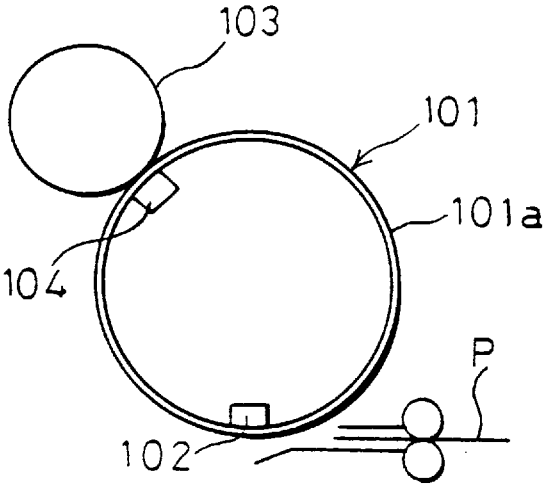
FIG. 31 PRIOR ART
FIG. 31 schematically shows the structure of a transfer drum in a conventional image forming apparatus.
Figure 32:
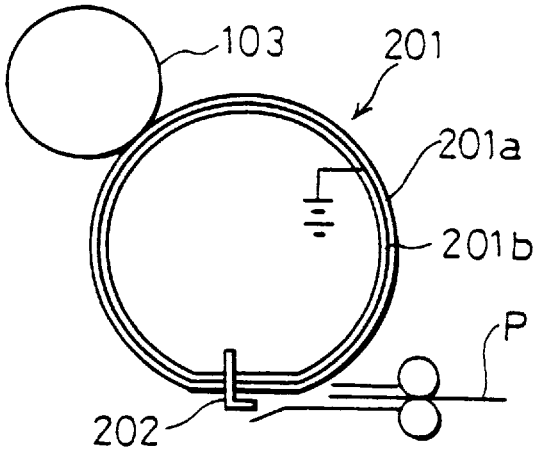
FIG. 32 PRIOR ART
FIG. 32 schematically shows the structure of a transfer drum in another conventional image forming apparatus.
Figure 33:
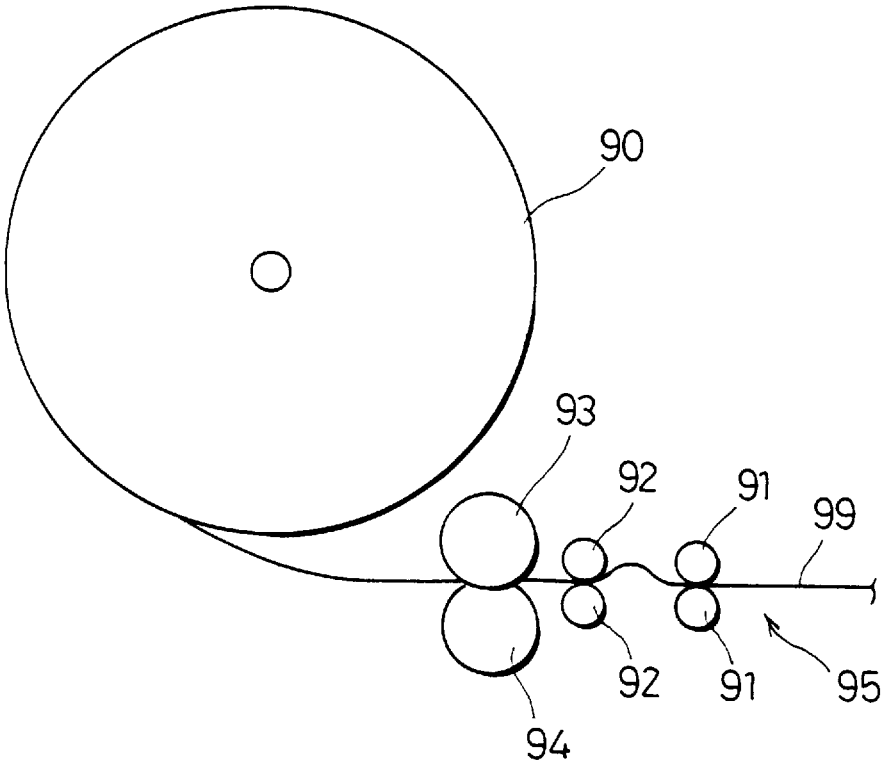
FIG. 33 PRIOR ART
FIG. 33 is a front view schematically showing a structure near a conventional transfer drum.
Figure 34:
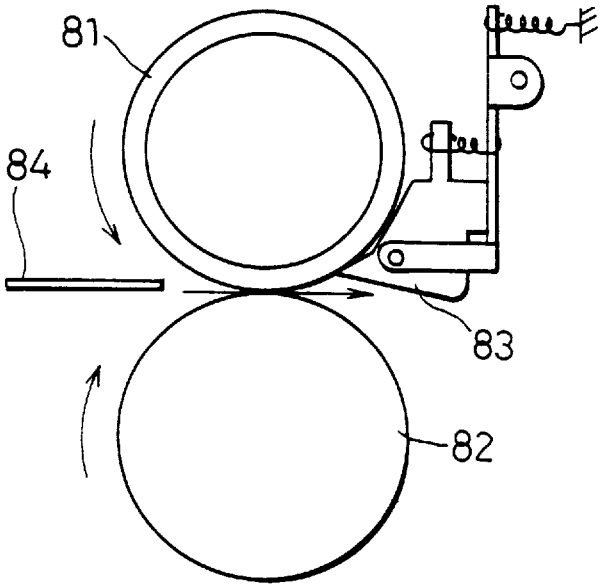
FIG. 34 PRIOR ART
FIG. 34 is a front view schematically showing the structure of a conventional separating claw.
Figure 35:
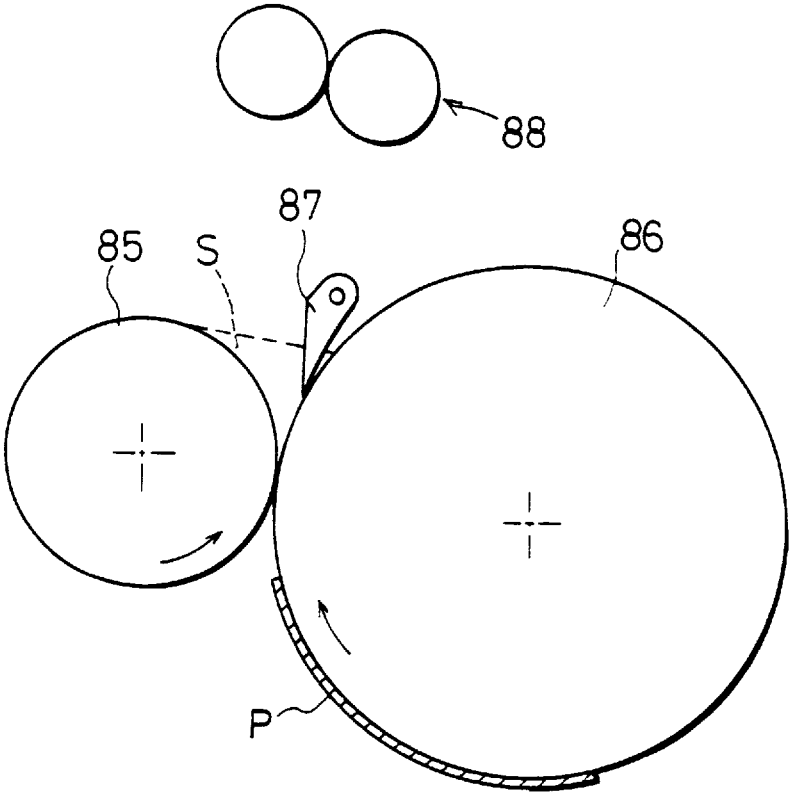
FIG. 35 PRIOR ART
FIG. 35 is a front view schematically showing a positional relation among a photoreceptor drum, a transfer drum and a separating claw in the conventional image forming apparatus.
Figure 36:
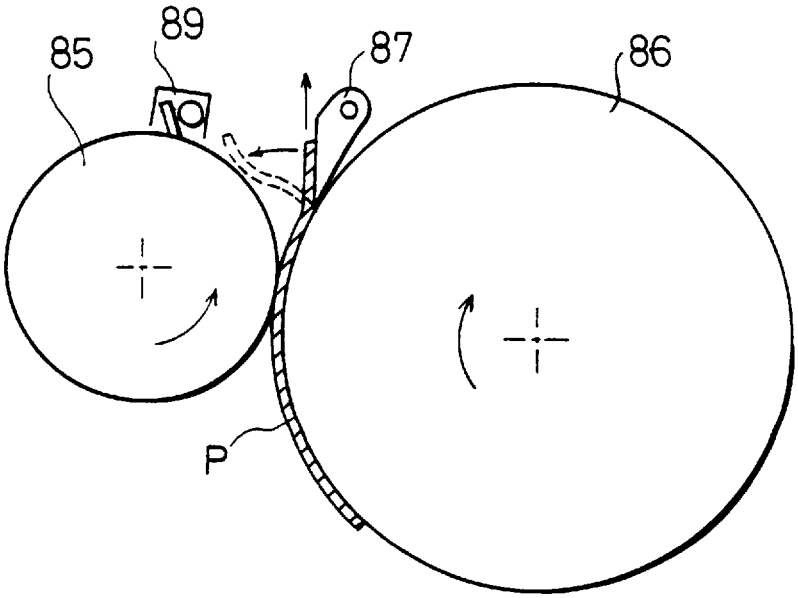
FIG. 36 PRIOR ART
FIG. 36 is a front view schematically explaining how the recording paper is separated from the transfer drum of FIG. 36.

After the transfer step (after the final transfer step when performing multi-color printing), the separating claw 71 separates the transfer paper P from the transfer drum 11 and is pressed against the transfer drum 11 for a predetermined time so as to feed the transfer paper P to the fixing unit 4. The timing for making the separating claw 71 contact with and separate from the transfer drum 11 is shown in FIG. 30. Specifically, after the front edge of the transfer paper P passes through the contact point a and reaches a point e, the position of the separating claw 71 is switched to the contact position from the distant position. As illustrated in FIG. 29, the point e is set so that the length of an arc of the outer surface of the transfer drum 11 from the separation point c to the point e becomes $L_1$.

When a detection sensor (not shown) detects that the front edge of the transfer paper P passes through the point e, the solenoid 72 is energized by a control device (not shown), and the separating claw 71 is moved to the contact position. The length $L_1$ from the point e to the point c is set by considering the variations in detecting the transfer paper P and the time taken for driving the separating claw 71. If the length $L_1$ is too short, a delay is caused when bringing the separating claw 71 into contact with the transfer drum 11 after the detection of the front edge of the transfer paper P. In this case, since the separating claw 71 is driven after the front edge of the transfer paper P passes through the point e, the transfer paper P can not be separated from the transfer drum 11. Optimum values calculated through experiments in this embodiment are as follows. $L_1$ is 10 mm, and the minimum value in an allowable range of the length $L_1$ is 2 mm.

Whereas, when the front edge of the transfer paper P is lifted up by the separating claw 71 and separated from the transfer drum 11 by bringing the separating claw 71 into contact with the transfer drum 11 as mentioned above, the position of the separating claw 71 is switched from the contact position to the distant position before the rear edge of the transfer paper P is separated from the transfer drum 11 by the separating claw 71 in this embodiment. Namely, as shown in FIG. 30, the separating claw 71 is controlled to move to the contact position when the transfer paper P passes through the point e. Then, as shown in FIG. 29, the separating claw 71 is controlled to move from the contact position to the distant position when the front edge of the transfer paper P is moved by a length $L_2$ from the point c.

Thus, the separating claw 71 is brought into contact with the transfer drum 11 just before the front edge of the transfer paper P reaches the separating point c, and is separated from the transfer drum 11 just after the front edge thereof passes through the separating point c. Hence, the contact time of the separating claw 71 and the transfer drum 11 is significantly shortened. As a result, the influence of the separating claw 71 on the transfer drum 11 is reduced, scratching the surface of the transfer drum 11 is decreased, and the durability of the transfer drum 11 is improved.

The length $L_2$ is also determined by considering the detection variations of the detecting sensor, not shown. For example, if the length $L_2$ is too short, the separating claw 71 is separated from the transfer drum 11 too early, thereby causing a possibility that the front edge of the transfer paper P is moved away from the separating claw 71 to a large degree. At this time, similar to the case where the separation point c is located too close to the contact point a, the printing performance and transporting performance are degraded. Optimum values calculated through experiments in this embodiment are as follows. $L_2$ is 10 mm, and the minimum value in an allowable range of the length $L_2$ is 2 mm.

In this embodiment, the installation position and the contact and separating timing of the separating claw 71 are set as explained above. These arrangements prevent disorderly images, improve the transporting performance by preventing paper jam of the transfer paper P, and increase the durability of the transfer drum 11.

In this embodiment, although the cylindrical photoreceptor drum 15 and transfer drum 11 are explained as examples of the image carrying body and the transfer body, respectively, it is also possible to apply the present invention to an apparatus in which both or one of the image carrying body and the transfer body are shaped into belt form. In this case, the cylindrical surfaces which are formed around the driving rollers by winding the belt-shaped image carrying body and transfer body on the driving rollers are brought into contact with each other. As a result, the transfer area where a transfer of the toner image is carried out is produced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus comprising:

an image carrying body on which a toner image is formed;

transfer means for transferring the toner image formed on said image carrying body to transfer paper by bringing the transfer paper into contact with said image carrying body;

a pair of register rollers for supplying the transfer paper to said transfer means at a predetermined time and for curling the transfer paper in an arc, wherein said register rollers includes a first roller of a predetermined hardness and a second roller of a hardness larger than that of said first roller, said first and second rollers being pressed against each other, said transfer means is disposed on the same side as said second roller with respect to an imaginary tangent line touching a surface of said second roller at one end of a contact section between said first and second rollers which is closer to said transfer means than the other end thereof; and transporting means for supplying the transfer paper to said register rollers so that a front edge of the transfer paper comes into contact with said second roller, wherein said register rollers temporarily stop the transfer paper having been supplied thereto, and thereafter, supply to said transfer means the transfer paper having been stopped.

2. The image forming apparatus according to claim 1, further comprising pressure changing means for freely changing a pressure for pressing said first and second rollers with each other.

3. The image forming apparatus according to claim 2, further comprising detecting means for detecting a type, paper quality, thickness and size of the transfer paper, wherein said pressure changing means is controlled to change the pressure according to an output of said detecting means.

4. The image forming apparatus according to claim 1, wherein a diameter ratio of said first roller to said second roller is set in a range between 0.2 and 1.0.

5. The image forming apparatus according to claim 1, wherein said transfer means is formed into a cylindrical shape as a transfer drum, and said transfer drum is disposed so that the front edge of the transfer paper comes into contact with the surface of said transfer drum after the front edge of the transfer paper passes a perpendicular line from an axis of said transfer drum to said tangent line.

6. The image forming apparatus according to claim 2, wherein said pressure changing means includes a resilient member for pressing said second roller against said first roller, and a changing member for changing an amount of resilient deformation of said resilient member.

7. The image forming apparatus according to claim 6, wherein said resilient member is a spring having an end connected to an axis of said second roller, and said changing member has an end connected to the axis of said second roller, a rotation shaft which rotates on a supporting point located between one end of said rotation shaft and other end thereof, and a cam for changing an amount of rotation of the other end of said rotation shaft.

8. The image forming apparatus according to claim 7, wherein said changing member further includes a rotation-amount changing member for changing a rotation amount of said cam; and said rotating-amount changing member includes a gear mounted on the same shaft as said cam, and a flapper which is freely engaged with and disengaged from said gear.

9. The image forming apparatus according to claim 1, comprising:

a first transport path including another pair of register rollers for supplying the transfer paper to said transfer means at a Predetermined time;

a second transport path including said first and second rollers and being different from said first transport path;

switching means for switching a transport of the transfer paper between a transport using said first transport path and a transport using said second transport path, wherein said register rollers in said first transport path have a substantially uniform hardness.

10. The image forming apparatus according to claim 9, wherein said first transport path is located closer to said transfer means than said second transport path to said transfer means.

11. The image forming apparatus according to claim 9, further comprising a storage member for storing the transfer paper, wherein said first and second transport paths join together at a junction located in an upstream section of said first and second transport paths in the transporting direction of the transfer paper, and said transporting means includes a sheet transport path for guiding the transfer paper from said storage member to said junction, and a manual-feed transport path which joins said sheet transport path and guides the transfer paper to said junction from a sheet supply opening formed in a main body of said image forming apparatus.

12. The image forming apparatus according to claim 1, wherein a time at which said register rollers are driven so as to supply to said transfer means the transfer paper having been temporarily stopped by said register rollers is in accordance with a degree of curve of the transfer paper between said register rollers and said transporting means.

13. An image forming apparatus comprising:

an image carrying body on which a toner image is formed;

transfer means for transferring the toner image formed on said image carrying body to transfer paper by bringing the transfer paper into contact with said image carrying body;

a pair of register rollers for supplying the transfer paper to said transfer means at a predetermined time and for curling the transfer paper in an arc, wherein said register rollers includes a first roller of a predetermined hardness and a second roller of a hardness larger than that of said first roller, said first and second rollers being pressed against each other, said transfer means is disposed on the same side as said second roller with respect to an imaginary tangent line touching a surface of said second roller at one end of a contact section between said first and second rollers which is closer to said transfer means than the other end thereof;

pressure changing means for freely changing a pressure for pressing said first and second rollers with each other; and detecting means for detecting a type, paper quality, thickness and size of the transfer paper, wherein said pressure changing means is controlled to change the pressure according to an output of said detecting means.

14. The image forming apparatus according to claim 13, wherein said transfer means is formed into a cylindrical shape as a transfer drum, and said transfer drum is disposed so that the front edge of the transfer paper comes into contact with the surface of said transfer drum after the front edge of the transfer paper passes a perpendicular line from an axis of said transfer drum to said tangent line.

15. An image forming apparatus comprising:

an image carrying body on which a toner image is formed;

transfer means for transferring the toner image formed on said image carrying body to transfer paper by bringing the transfer paper into contact with said image carrying body;

a pair of register rollers for supplying the transfer paper to said transfer means at a predetermined time and for curling the transfer paper in an arc, wherein said register rollers includes a first roller of a predetermined hardness and a second roller of a hardness larger than that of said first roller, said first and second rollers being pressed against each other, said transfer means is disposed on the same side as said second roller with respect to an imaginary tangent line touching a surface of said second roller at one end of a contact section between said first and second rollers which is closer to said transfer means than the other end thereof;

pressure changing means for freely changing a pressure for pressing said first and second rollers with each other, wherein said pressure changing means includes a resilient member for pressing said second roller against said first roller, and a changing member for changing an amount of resilient deformation of said resilient member.

16. The image forming apparatus according to claim 15, wherein said resilient member is a spring having an end connected to an axis of said second roller, and said changing member has an end connected to the axis of said second roller, a rotation shaft which rotates on a supporting point located between one end of said rotation shaft and other end thereof, and a cam for changing an amount of rotation of the other end of said rotation shaft.

17. The image forming apparatus according to claim 16, wherein said changing member further includes a rotation-amount changing member for changing a rotation amount of said cam; and said rotating-amount changing member includes a gear mounted on the same shaft as said cam, and a flapper which is freely engaged with and disengaged from said gear.

* * * * *

UNITED STATES PATENT AND TRADEMARK OFFICE

CERTIFICATE OF CORRECTION

PATENT NO.: 5,812,913

DATED: September 22, 1998

INVENTOR(S): Terry L. Morris; Thomas A. Speckhard; Yoshinori Akichika; Kenneth D. Wilson; Michael E. Kaszynski It is certified that error appears in the above-identified patent and that said Letters Patent is hereby corrected as shown below:

On the title page:
Under Assignee, also include --Nippon Steel Corporation, Tokyo, Japan – as second assignee Signed and Sealed this Thirty-first Day of August, 1999

*Attest:*

Q. TODD DICKINSON

*Attesting Officer*

*Acting Commissioner of Patents and Trademarks*